US009303881B2

(12) United States Patent
Wakashima et al.

(10) Patent No.: US 9,303,881 B2
(45) Date of Patent: Apr. 5, 2016

(54) AIR CONDITIONING APPARATUS

(75) Inventors: Masahiro Wakashima, Sakai (JP); Satoshi Asada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 766 days.

(21) Appl. No.: 13/119,252

(22) PCT Filed: Sep. 14, 2009

(86) PCT No.: PCT/JP2009/004550

§ 371 (c)(1),
(2), (4) Date: Mar. 16, 2011

(87) PCT Pub. No.: WO2010/032412

PCT Pub. Date: Mar. 25, 2010

(65) Prior Publication Data

US 2011/0167848 A1 Jul. 14, 2011

(30) Foreign Application Priority Data

Sep. 17, 2008 (JP) ..... 2008-238722

(51) Int. Cl.
*F24F 1/14* (2011.01)
*F24F 1/06* (2011.01)
(Continued)

(52) U.S. Cl.
CPC ... *F24F 1/14* (2013.01); *F24F 1/06* (2013.01); *F24F 1/30* (2013.01); *F25B 47/006* (2013.01);
(Continued)

(58) Field of Classification Search
CPC ..... F24F 1/14; F24F 1/06; F24F 1/30; F24F 2011/0089; F24F 2011/087; F24F 2013/221; F25B 47/006; F25B 47/022; F25B 2313/02741; F25B 47/02; F25B 2347/02
USPC ..... 62/205, 503, 324.1, 498, 524
See application file for complete search history.

(56) References Cited

U.S. PATENT DOCUMENTS 3,077,084 A * 2/1963 De Kanter ..... F24F 1/06 62/278
5,794,690 A * 8/1998 Kim et al. ..... 165/151
2002/0134099 A1* 9/2002 Mochizuki et al. ..... 62/285

FOREIGN PATENT DOCUMENTS

EP 1645817 A2 4/2006
JP 58-25957 U 8/1983
(Continued)

OTHER PUBLICATIONS

Office Action of divisional application of corresponding Japanese Application No. 2010-163191 dated May 29, 2012.
(Continued)

*Primary Examiner* — Allana Lewin Bidder
*Assistant Examiner* — Kun Kai Ma
(74) *Attorney, Agent, or Firm* — Global IP Counselors

(57) ABSTRACT

An air conditioning apparatus includes a compression mechanism, a heat source-side heat exchanger, an expansion mechanism, a usage-side heat exchanger, a blower, housings and a bypass circuit. The blower feeds an air flow to the heat source-side heat exchanger. The housings is configured to accommodate the heat source-side heat exchanger and the blower in a space above the bottom plate. The bypass circuit is disposed so as to pass below the blower and the heat source-side heat exchanger. The bypass circuit is configured to bypass a third refrigerant tube on a discharge side of the compression mechanism, and at least one of a first refrigerant tube and a second refrigerant tube. The first refrigerant tube extends from the usage-side heat exchanger to the expansion mechanism. The second refrigerant tube extends from the expansion mechanism to the heat source-side heat exchanger.

14 Claims, 38 Drawing Sheets

(51) Int. Cl.

| | |
|---|---|
| ***F24F 1/30*** | (2011.01) |
| ***F25B 47/00*** | (2006.01) |
| *F24F 11/00* | (2006.01) |
| *F25B 13/00* | (2006.01) |
| *F25B 47/02* | (2006.01) |

(52) U.S. Cl.
CPC ..... *F24F 2011/0089* (2013.01); *F25B 13/00* (2013.01); *F25B 47/022* (2013.01); *F25B 2313/02741* (2013.01)

(56) References Cited

FOREIGN PATENT DOCUMENTS

| | | | | |
|---|---|---|---|---|
| JP | 60-77974 | U | | 5/1985 |
| JP | 61-133775 | U | | 8/1986 |
| JP | 63-69926 | U | | 5/1988 |
| JP | 63-178762 | U | | 11/1988 |
| JP | 64-8176 | U | | 1/1989 |
| JP | 02085662 | A | * | 3/1990 |
| JP | 6-249465 | A | | 9/1994 |
| JP | 8-200745 | A | | 8/1996 |
| JP | 2002061924 | A | * | 2/2002 |
| JP | 2004-347135 | A | | 12/2004 |
| JP | 2005049002 | A | * | 2/2005 |
| JP | 2005-055024 | A | | 3/2005 |
| JP | 2005233450 | A | * | 9/2005 |
| JP | 2006-17420 | A | | 1/2006 |
| JP | 2006-105560 | A | | 4/2006 |
| JP | 2007-285635 | A | | 11/2007 |
| JP | 2008-96018 | A | | 4/2008 |
| JP | 2008096018 | A | * | 4/2008 |

OTHER PUBLICATIONS

International Search Report of corresponding PCT Application No. PCT/JP2009/004550.

Japanese Office Action of corresponding Japanese Application No. 2008-238722 dated Apr. 13, 2010.

Japanese Office Action of corresponding Japanese Application No. 2008-238722 dated Oct. 19, 2010.

International Preliminary Report of corresponding PCT Application No. PCT/JP2009/004550.

* cited by examiner

AIR CONDITIONING APPARATUS

CROSS-REFERENCE TO RELATED APPLICATIONS

This U.S. National stage application claims priority under 35 U.S.C. §119(a) to Japanese Patent Application No. 2008-238722, filed in Japan on Sep. 17, 2008, the entire contents of which are hereby incorporated herein by reference.

TECHNICAL FIELD

The present invention relates to an air conditioning apparatus.

BACKGROUND ART

During air-warming operation, a heat exchanger provided to an outdoor unit functions as a refrigerant evaporator. The outdoor air therefore condenses on the surface of the outdoor heat exchanger, and drain water is sometimes formed. Under such conditions, since the outdoor unit of the air conditioning apparatus is sometimes exposed to environments of 0° C. or lower during winter, the drain water sometimes freezes. The surface of the outdoor heat exchanger therefore becomes covered with ice, and the heat exchange performance thereof may decrease.

In contrast, a technique is proposed in the air conditioning apparatus disclosed in Japanese Unexamined Patent Application Publication No. 2008-96018 in which a heater is provided on the top surface of a bottom plate for supporting the outdoor heat exchanger of the outdoor unit, and ice is prevented from forming. Water or drain water which is thawed through the use of the heater is discharged via a water escape hole provided to the bottom plate, and it is therefore possible to suppress the growth of ice on the top surface of the bottom plate.

SUMMARY

Problems to be Solved by the Invention

However, in an air conditioning apparatus such as described above, a heater must be prepared separately from the refrigeration cycle in order to suppress the growth of ice on the bottom plate of the outdoor unit. The number of parts therefore increases.

The present invention was developed in view of the foregoing, and an object of the present invention is to provide an air conditioning apparatus whereby the growth of ice on the bottom plate of the outdoor unit can be suppressed without the use of a configuration that is distinguished from the refrigeration cycle, such as a heater.

Means for Solving the Problems

An air conditioning apparatus according to a first aspect of the present invention is an air conditioning apparatus having a compression mechanism, a heat source-side heat exchanger, an expansion mechanism, and a usage-side heat exchanger, and is provided with a blower, housings, and a bypass circuit. The blower feeds an air flow to the heat source-side heat exchanger. The housings have a bottom plate, and accommodate the heat source-side heat exchanger and the blower in a space above the bottom plate. The bypass circuit bypasses a third refrigerant tube on the discharge side of the compression mechanism, and at least any one of a first refrigerant tube which extends from the usage-side heat exchanger to the expansion mechanism, and a second refrigerant tube which extends from the expansion mechanism to the heat source-side heat exchanger, the bypass circuit being disposed so as to pass below the blower and below the heat source-side heat exchanger.

In this air conditioning apparatus, depending on the environment in which the housings are installed, the top of the bottom plate is sometimes wetted by rainwater or drain water that forms in the heat source-side heat exchanger. On the other hand, the bypass circuit is provided so as to pass through the vicinity of the portion of the bottom plate of the housings below the blower and below the heat source-side heat exchanger. The vicinity of the portion through which the bypass circuit passes can therefore be warmed without the use of a separate heat source such as a heater. The growth of ice on the bottom plate below the blower and below the heat source-side heat exchanger can thereby be suppressed even when the top of the bottom plate becomes wet. It is thereby possible to prevent a condition in which operation of the blower is hindered by ice, or the surface of the heat source-side heat exchanger is covered with ice and heat exchange efficiency is reduced.

An air conditioning apparatus according to a second aspect of the present invention is the air conditioning apparatus according to the first aspect of the present invention, wherein the bypass circuit passes below the heat source-side heat exchanger after passing below the blower from the third refrigerant tube, and extends to at least any one of the first refrigerant tube and the second refrigerant tube.

In this air conditioning apparatus, priority can be placed on preventing growth of ice below the blower.

An air conditioning apparatus according to a third aspect of the present invention is the air conditioning apparatus according to the second aspect of the present invention, wherein the bottom plate does not have an opening which penetrates through in the plate-thickness direction in the portion positioned on the side of the blower with respect to the heat source-side heat exchanger in planar view.

In this air conditioning apparatus, the bottom plate does not have an opening in the vicinity of the area below the blower. Since there is therefore no communication with the portion positioned on the side of the blower with respect to the heat source-side heat exchanger in planar view, an air flow that does not pass through the heat source-side heat exchanger can be prevented from forming in the state in which the blower is activated. In a case in which water adheres to the bottom plate below the blower, the absence of a nearby opening makes freezing prone to occur, but a priority supply of heat is provided to the bottom plate below the blower by the refrigerant that passes through the bypass circuit. It is thereby possible to efficiently suppress the growth of ice below the blower while enhancing the efficiency with which the air flow created by the blower passes through the heat source-side heat exchanger.

An air conditioning apparatus according to a fourth aspect of the present invention is the air conditioning apparatus according to the second or third aspect of the present invention, wherein the bottom plate has drainage ports which penetrate through in the plate-thickness direction below the heat source-side heat exchanger.

In this air conditioning apparatus, water that accumulates below the heat source-side heat exchanger can be induced to drain out by the drainage ports. Water that accumulates on the bottom plate below the blower, however, is prone to freeze due to the absence of a nearby opening, but a priority supply of heat is provided to the bottom plate below the blower by the refrigerant that passes through the bypass circuit. Growth of ice can thereby be efficiently suppressed with priority for the area below the blower, in which water is more prone to freeze than in the area below the heat source-side heat exchanger.

An air conditioning apparatus according to a fifth aspect of the present invention is the air conditioning apparatus according to any of the first through fourth aspects of the present invention, wherein the heat source-side heat exchanger has a compression mechanism-side passage port which is a refrigerant passage port on the side of the compression mechanism, an expansion mechanism-side passage port which is a refrigerant passage port on the side of the expansion mechanism, and heat exchange flow passages which extend so as to exchange heat between an outside liquid and the refrigerant that passes through from the compression mechanism-side passage port to the expansion mechanism-side passage port. The heat exchange flow passages have a first branch point; a second branch point provided closer to the expansion mechanism-side passage port than the first branch point; a first branch tube and second branch tube for connecting the first branch point and the second branch point by an independent path; and a juncture tube which connects the second branch point and the expansion mechanism-side passage port and passes below at least any one of the first branch tube and the second branch tube.

In this air conditioning apparatus, the effective surface area of heat exchange can be increased by feeding refrigerant to both the first branch tube and the second branch tube. Ice can also be made less prone to form below the heat source-side heat exchanger by the refrigerant that flows in concentrated fashion in the juncture tube.

The advantageous effects described below can be obtained by the aspect of the present invention obtained by applying the fifth aspect of the present invention to the second aspect of the present invention. Specifically, the area below the heat source-side heat exchanger can be warmed by the juncture tube. However, the temperature of the area below the blower is prone to depend on changes in the surrounding environment, and the growth of ice can sometimes be difficult to suppress. However, in the aspect of the present invention obtained by applying the fifth aspect of the present invention to the second aspect of the present invention, the growth of ice in the area below the blower can be more reliably suppressed by sending hot gas to the area below the blower at a higher priority than to the area below the heat source-side heat exchanger, so as to give the supply of hot gas to the area below the blower priority over the supply of hot gas to the area below the heat source-side heat exchanger.

An air conditioning apparatus according to a sixth aspect of the present invention is the air conditioning apparatus according to the fifth aspect of the present invention, wherein the heat source-side heat exchanger further comprises fins. The fins are penetrated through by at least any one of the juncture tube and the first branch tube and the second branch tube, and the penetrating portion of at least any one of the first branch tube and the second branch tube, and the penetrating portion of the juncture tube are connected.

In this air conditioning apparatus, a single fin can be used in common for heat exchange of the juncture tube and heat exchange of at least any one of the first branch tube and the second branch tube.

An air conditioning apparatus according to a seventh aspect of the present invention is the air conditioning apparatus according to any of the first through sixth aspects of the present invention, wherein at least the portion of the bottom plate in the vicinity of the portion through which the bypass circuit passes has bypass gutters formed so as to sink downward. At least a portion of the bypass circuit is disposed on the top side of the bypass gutters in a space lower than the periphery of the bypass gutters.

In this air conditioning apparatus, drain water, rainwater, and other water readily accumulates in the portion of the bottom plate in which the bypass gutters are formed. However, a portion of the bypass circuit is disposed on the top side of the bypass gutters in a space lower than the periphery of the bypass gutters. Water or ice in the bypass gutters can therefore be warmed by the refrigerant that flows through the bypass circuit. It is thereby possible to enhance the effects that the growth of ice on the bottom plate is suppressed.

An air conditioning apparatus according to an eighth aspect of the present invention is the air conditioning apparatus according to the seventh aspect of the present invention, wherein the bypass gutters have inclined portions. The bottom plate has gutter openings which penetrate through in the plate-thickness direction in the vicinity of the bottom end of the inclined portions of the bypass gutters. The gutter openings of the eighth aspect of the present invention and the drainage ports of the fourth aspect of the present invention may be the same openings.

In this air conditioning apparatus, water formed by thawing of ice or drain water that accumulates in the bypass gutters can be directed to the gutter openings and drained from the gutter openings. Water can thereby be induced to drain out before freezing of drain water or refreezing of water formed by thawing occurs.

An air conditioning apparatus according to a ninth aspect of the present invention is the air conditioning apparatus according to the eighth aspect of the present invention, wherein the bypass circuit has a portion that is inclined so that the portion thereof passing above the gutter openings is the bottom end.

In this air conditioning apparatus, water that flows along the area near the bottom end of the bypass tube is directed by the inclination to the vicinity of the area above the gutter openings. Drainage can thereby be facilitated.

An air conditioning apparatus according to a tenth aspect of the present invention is the air conditioning apparatus according to the eighth or ninth aspect of the present invention, wherein at least a portion of the portion of the bypass circuit that passes below the heat source-side heat exchanger is positioned above the gutter openings.

In this air conditioning apparatus, since at least a portion of the portion of the bypass circuit that passes below the heat source-side heat exchanger passes over the gutter openings, it is possible to prevent a state in which the gutter openings are blocked by freezing or refreezing.

An air conditioning apparatus according to an eleventh aspect of the present invention is the air conditioning apparatus according to any of the first through tenth aspects of the present invention, further comprising a connection switching valve connected to an end part of the third refrigerant tube on the opposite side from the compression mechanism. The connection switching valve is capable of switching between a first connection state in which refrigerant discharged from the compression mechanism is directed toward the usage-side heat exchanger, and a second connection state in which refrigerant discharged from the compression mechanism is directed toward the heat source-side heat exchanger.

In this air conditioning apparatus, air-cooling operation and air-warming operation can both be realized by switching the connection state.

In relation to the fifth aspect of the present invention, it is possible to make uniform the degree of supercooling of the portion of the refrigerant that flows through the juncture tube among the refrigerant sent to the expansion mechanism during air-cooling operation. The degree of supercooling of the refrigerant flowing out from the heat source-side heat exchanger can thereby be made uniform even when there is error in the degree of supercooling for each branch tube, due to the refrigerant having come through the first and second branch tubes.

An air conditioning apparatus according to a twelfth aspect of the present invention is the air conditioning apparatus according to any of the first through eleventh aspects of the present invention, wherein the bypass circuit has a depressurizing mechanism for reducing the pressure of the refrigerant that passes through the bypass circuit, and the bypass circuit bypasses the second refrigerant tube that extends from the expansion mechanism to the heat source-side heat exchanger, and the third refrigerant tube on the discharge side of the compression mechanism.

In this air conditioning apparatus, the pressure of the refrigerant discharged from the compression mechanism can be reduced to near the pressure of the bypass destination. It is thereby possible to minimize the degree to which the pressure of the refrigerant flowing through the second refrigerant tube is increased by the supply of hot gas to the second refrigerant tube through the bypass circuit.

An air conditioning apparatus according to a thirteenth aspect of the present invention is the air conditioning apparatus according to any of the first through twelfth aspects of the present invention, further comprising a bypass switching part which is capable of switching between a state of allowing the flow of refrigerant in the bypass circuit and a state of not allowing the flow of refrigerant in the bypass circuit.

In this air conditioning apparatus, it is possible to switch between a state of utilizing the bypass circuit, and a state of not utilizing the bypass circuit.

An air conditioning apparatus according to a fourteenth aspect of the present invention is the air conditioning apparatus according to the thirteenth aspect of the present invention, further comprising a switch controller for switching the state of the bypass switching part to the state of allowing the flow of refrigerant in the bypass circuit in a case in which a defrost operation is performed for removing frost that adheres to the heat source-side heat exchanger.

In this air conditioning apparatus, air-warming capability is reduced when refrigerant is always allowed to flow to the bypass circuit. However, since a limitation is imposed in this configuration in the case of performing a defrost operation, the reduction in air-warming capability can be minimized.

Advantageous Effects of the Invention

In the air conditioning apparatus according to the first aspect of the present invention, it is possible to prevent a condition in which operation of the blower is hindered by ice, or the surface of the heat source-side heat exchanger is covered with ice and heat exchange efficiency is reduced.

In the air conditioning apparatus according to the second aspect of the present invention, priority can be placed on preventing growth of ice below the blower.

In the air conditioning apparatus according to the third aspect of the present invention, it is possible to efficiently suppress the growth of ice below the blower while enhancing the efficiency with which the air flow created by the blower passes through the heat source-side heat exchanger.

In the air conditioning apparatus according to the fourth aspect of the present invention, growth of ice can be efficiently suppressed with priority for the area below the blower, in which water is more prone to freeze than in the area below the heat source-side heat exchanger.

In the air conditioning apparatus according to the fifth aspect of the present invention, it is possible to make ice less prone to form below the heat source-side heat exchanger, while increasing the effective surface area of heat exchange.

In the air conditioning apparatus according to the sixth aspect of the present invention, a single fin can be used in common.

In the air conditioning apparatus according to the seventh aspect of the present invention, it is possible to enhance the effects whereby the growth of ice on the bottom plate is suppressed.

In the air conditioning apparatus according to the eighth aspect of the present invention, water can be induced to drain out before freezing of drain water or refreezing of water formed by thawing occurs.

In the air conditioning apparatus according to the ninth aspect of the present invention, drainage can be facilitated.

In the air conditioning apparatus according to the tenth aspect of the present invention, it is possible to prevent a state in which the gutter openings are blocked by freezing or refreezing.

In the air conditioning apparatus according to the eleventh aspect of the present invention, air-cooling operation and air-warming operation can both be realized by switching the connection state.

In the air conditioning apparatus according to the twelfth aspect of the present invention, it is possible to minimize the degree to which the pressure of the refrigerant flowing through the second refrigerant tube is increased by the supply of hot gas to the second refrigerant tube through the bypass circuit.

In the air conditioning apparatus according to the thirteenth aspect of the present invention, it is possible to switch between a state of utilizing the bypass circuit, and a state of not utilizing the bypass circuit.

In the air conditioning apparatus according to the fourteenth aspect of the present invention, the reduction in air-warming capability can be minimized.

DESCRIPTION OF EMBODIMENTS

The electromagnetic induction heating unit 6 and the air conditioning apparatus 1 provided therewith according to an embodiment of the present invention will be described below as examples with reference to the drawings.

<1-1> Air Conditioning Apparatus 1

Figure 1:
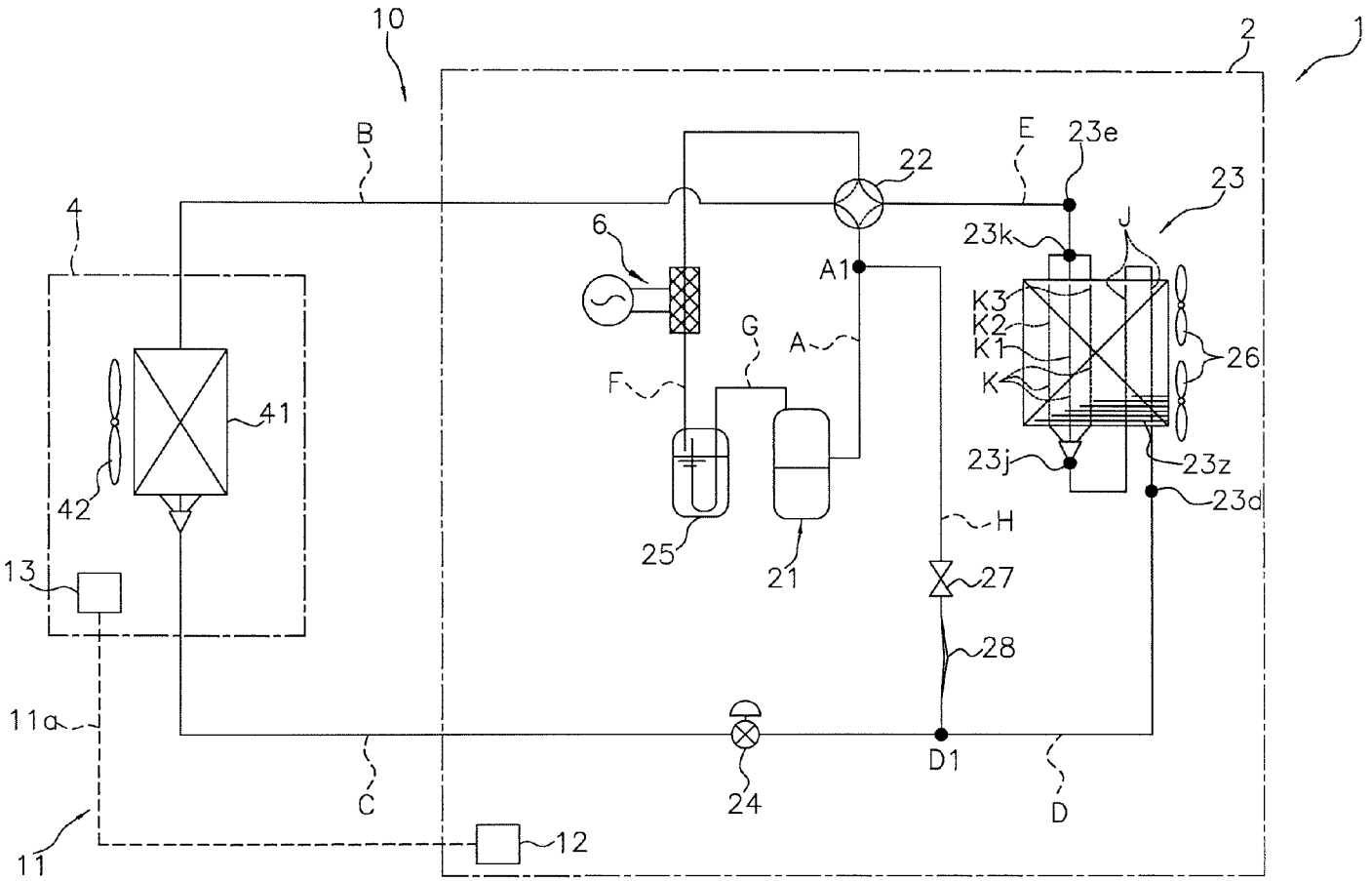
FIG. 1 is a refrigerant circuit diagram showing the air conditioning apparatus according to an embodiment of the present invention.

FIG. 1 is a refrigerant circuit diagram showing a refrigerant circuit 10 of the air conditioning apparatus 1.

In the air conditioning apparatus 1, an outdoor unit 2 as a heat source-side apparatus, and an indoor unit 4 as a usage-side apparatus are connected by a refrigerant tube, the air conditioning apparatus 1 performs air conditioning of a space in which a usage-side apparatus is placed, and the air conditioning apparatus 1 is provided with a compressor 21, a four-way switching valve 22, an outdoor heat exchanger 23, an outdoor motor-driven expansion valve 24, an accumulator 25, outdoor fans 26, an indoor heat exchanger 41, an indoor fan 42, a hot-gas bypass valve 27, a capillary tube 28, the electromagnetic induction heating unit 6, and other components.

The compressor 21, four-way switching valve 22, outdoor heat exchanger 23, outdoor motor-driven expansion valve 24, accumulator 25, outdoor fans 26, hot-gas bypass valve, capillary tube 28, and electromagnetic induction heating unit 6 are housed within the outdoor unit 2. The indoor heat exchanger 41 and the indoor fan 42 are housed within the indoor unit 4.

The refrigerant circuit 10 has a discharge tube A, an indoor-side gas tube B, an indoor-side liquid tube C, an indoor-side liquid tube D, an outdoor-side gas tube E, an accumulator tube F, an intake tube G, a hot-gas bypass circuit H, branch tubes K, and a juncture tube J. Large amounts of gas-state refrigerant pass through the indoor-side gas tube B and the outdoor-side gas tube E, but the refrigerant passing through is not limited to gas refrigerant. Large amount of liquid-state refrigerant pass through the indoor-side liquid tube C and the indoor-side liquid tube D, but the refrigerant passing through is not limited to liquid refrigerant.

The discharge tube A is connected to the compressor 21 and the four-way switching valve 22.

The indoor-side gas tube B is connected to the four-way switching valve 22 and the indoor heat exchanger 41.

The indoor-side liquid tube C is connected to the indoor heat exchanger 41 and the outdoor motor-driven expansion valve 24.

The indoor-side liquid tube D is connected to the outdoor motor-driven expansion valve 24 and the outdoor heat exchanger 23.

The outdoor-side gas tube E is connected to the outdoor heat exchanger 23 and the four-way switching valve 22.

The accumulator tube F is connected to the four-way switching valve 22 and the accumulator 25, and extends in the vertical direction in the installed state of the outdoor unit 2. The electromagnetic induction heating unit 6 is attached to a portion of the accumulator tube F. At least the heated portion of the accumulator tube F that is covered by the electromagnetic induction heating unit 6 is composed of copper tubing F1 covered on the periphery thereof by SUS (Stainless Used Steel: stainless steel) tubing F2 (see FIG. 7). The portion other than the SUS tubing of the tube that constitutes the refrigerant circuit 10 is composed of copper tubing. The material of the tubing for covering the periphery of the abovementioned copper tubing is not limited to SUS, and may be iron, copper, aluminum, chrome, nickel, or another conductor, or an alloy or the like containing two or more types of metals selected from these metals, for example. Examples of the SUS include ferritic and martensitic SUS as well as combinations of these two types. The accumulator tube F herein also may not necessarily be provided with a magnetic substance or a material that includes a magnetic substance, and preferably includes the substance in which induction heating is to take place. The magnetic material may constitute the entire accumulator tube F, may be used to form only the inside surface of the accumulator tube F, or may be present in the material constituting the accumulator tube F, for example. By this electromagnetic induction heating, the accumulator tube F can be heated by electromagnetic induction, and it is possible to heat the refrigerant that is drawn into the compressor 21 via the accumulator 25. The air-warming ability of the air conditioning apparatus 1 can thereby be enhanced. Even in a case in which the compressor 21 is not adequately warmed up at the start of air-warming operation, deficiency in performance can be overcome by the rapid heating provided by the electromagnetic induction heating unit 6. Furthermore, in a case in which the four-way switching valve 22 is switched to the state for air-cooling operation, and defrost operation is performed to remove frost from the outdoor heat exchanger 23, the electromagnetic induction heating unit 6 rapidly heats the accumulator tube F, and the compressor 21 can thereby compress rapidly warmed refrigerant. The temperature of the hot gas discharged from the compressor 21 can therefore be rapidly increased. The time needed for the defrost operation to melt the frost can thereby be shortened. It is thereby possible to return to air-warming operation as quickly as possible, and amenity to the customer can be enhanced even in a case in which a timely defrost operation must be performed during air-warming operation.

The intake tube G is connected to the accumulator 25 and the intake side of the compressor 21.

The hot-gas bypass circuit H connects a branch point A1 provided partway in the discharge tube A with a branch point D1 provided partway in the indoor-side liquid tube D. The hot-gas bypass valve 27, which is capable of switching between a state of allowing passage refrigerant and a state of not allowing passage of refrigerant, is disposed partway in the hot-gas bypass circuit H.

The branch tubes K constitute a portion of the outdoor heat exchanger 23, and are tubes which are branched into a plurality of tubes formed by branching of the refrigerant tube, which extends from a gas-side outlet/inlet 23*e* of the outdoor heat exchanger 23, at a branch juncture point 23*k* described hereinafter, in order to increase the effective surface area for heat exchange. The branch tubes K have a first branch tube K1, a second branch tube K2, and a third branch tube K3 extending mutually independently from the branch juncture point 23*k* to the juncture branch point 23*j*, and the branch tubes K1, K2, and K3 merge together at the juncture branch point 23*j*. When considered from the side of the juncture tube J, the arrangement represents a single tube branching out at the juncture branch point 23*j* and extending in the form of the branch tubes K.

The juncture tube J constitutes a portion of the outdoor heat exchanger 23, and is a tube which extends from the juncture branch point 23*j* to a liquid-side outlet/inlet 23*d* of the outdoor heat exchanger 23. The juncture tube J is capable of coordinating the degree of supercooling of the refrigerant that flows out from the outdoor heat exchanger 23 during air-cooling operation, and of thawing ice that forms in the vicinity of the lower end of the outdoor heat exchanger 23 during air-warming operation. The juncture tube J has a cross-sectional area that is about triple the cross-sectional area of the branch tubes K1, K2, and K3, and the rate at which the refrigerant passes through the tube is about triple that of the branch tubes K1, K2, and K3.

The four-way switching valve 22 is capable of switching between an air-cooling operation cycle and an air-warming operation cycle. In FIG. 1, the connection state for air-warming operation is indicated by solid lines, and the connection state for air-cooling operation is indicated by dashed lines. During air-warming operation, the indoor heat exchanger 41 functions as a refrigerant cooler, and the outdoor heat exchanger 23 functions as a refrigerant heater. During air-cooling operation, the outdoor heat exchanger 23 functions as a refrigerant cooler, and the indoor heat exchanger 41 functions as a refrigerant heater.

The outdoor heat exchanger 23 has the gas-side outlet/inlet 23*e*, the liquid-side outlet/inlet 23*d*, the branch juncture point 23*k*, the juncture branch point 23*j*, the branch tubes K, the juncture tube J, and heat exchange fins 23*z*. The gas-side outlet/inlet 23*e* is positioned at an end part on the side of the outdoor-side gas tube E of the outdoor heat exchanger 23, and is connected to the outdoor-side gas tube E. The liquid-side outlet/inlet 23*d* is positioned at an end part on the side of the indoor-side liquid tube D of the outdoor heat exchanger 23, and is connected to the indoor-side liquid tube D. The branch juncture point 23*k* branches the tube that extends from the gas-side outlet/inlet 23*e*, and can branch or merge the refrigerant, depending on the direction of refrigerant flow. The branch tubes K extend as a plurality of tubes from branching portions at the branch juncture point 23*k*. The juncture branch point 23*j* merges the branch tubes K and can merge or branch the refrigerant, depending on the direction of refrigerant flow. The juncture tube J extends from the juncture branch point 23*j* to the liquid-side outlet/inlet 23*d*. The heat exchange fins 23*z* are composed of a plurality of plate-shaped aluminum fins aligned in the plate thickness direction and arranged at a predetermined interval. The branch tubes K and the juncture tube J all pass through the heat exchange fins 23*z* in common. Specifically, the branch tubes K and the juncture tube J are arranged so as to pass through different portions of the same heat exchange fins 23*z* in the plate thickness direction thereof.

An outdoor controller 12 for controlling the devices provided in the outdoor unit 2, and an indoor controller 13 for controlling the devices provided in the indoor unit 4 are connected by a communication line 11*a*, and a controller 11 is thereby formed. The controller 11 performs various types of control of the air conditioning apparatus 1.

<1-2> Outdoor Unit 2

Figure 2:
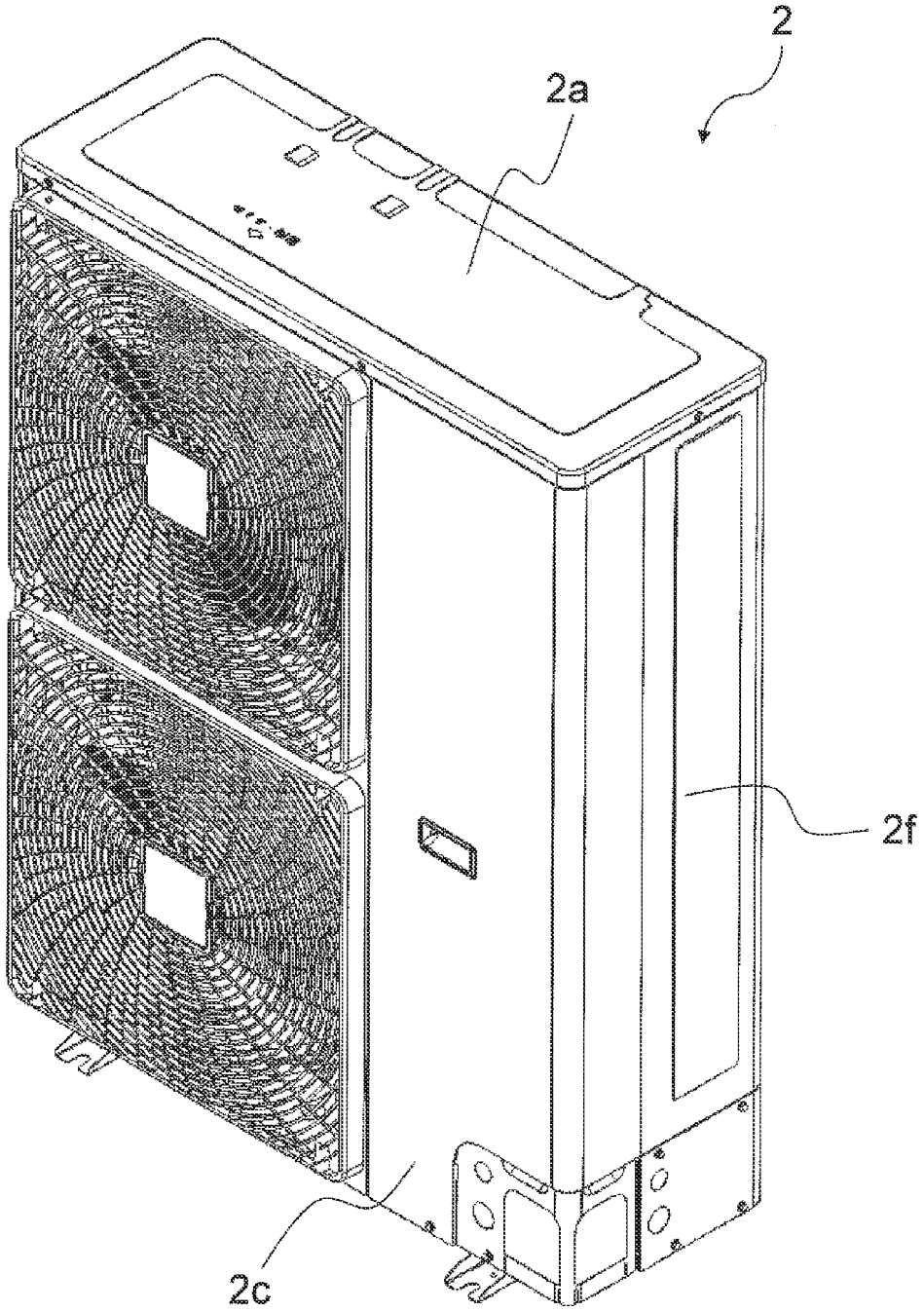
FIG. 2 is an external perspective view showing the front side of the outdoor unit.
Figure 3:
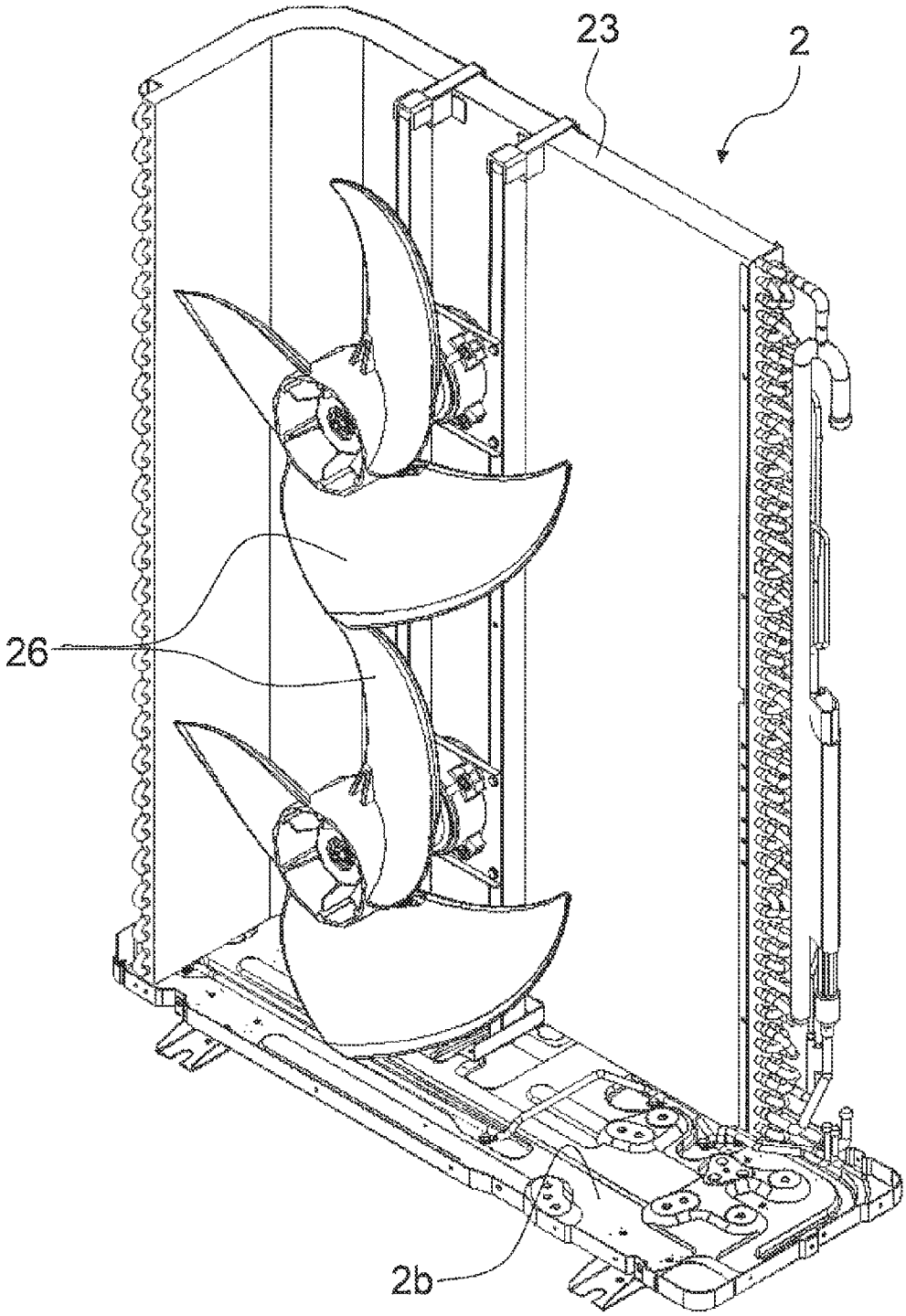
FIG. 3 is a perspective view showing the internal arrangement configuration of the outdoor unit.
Figure 4:
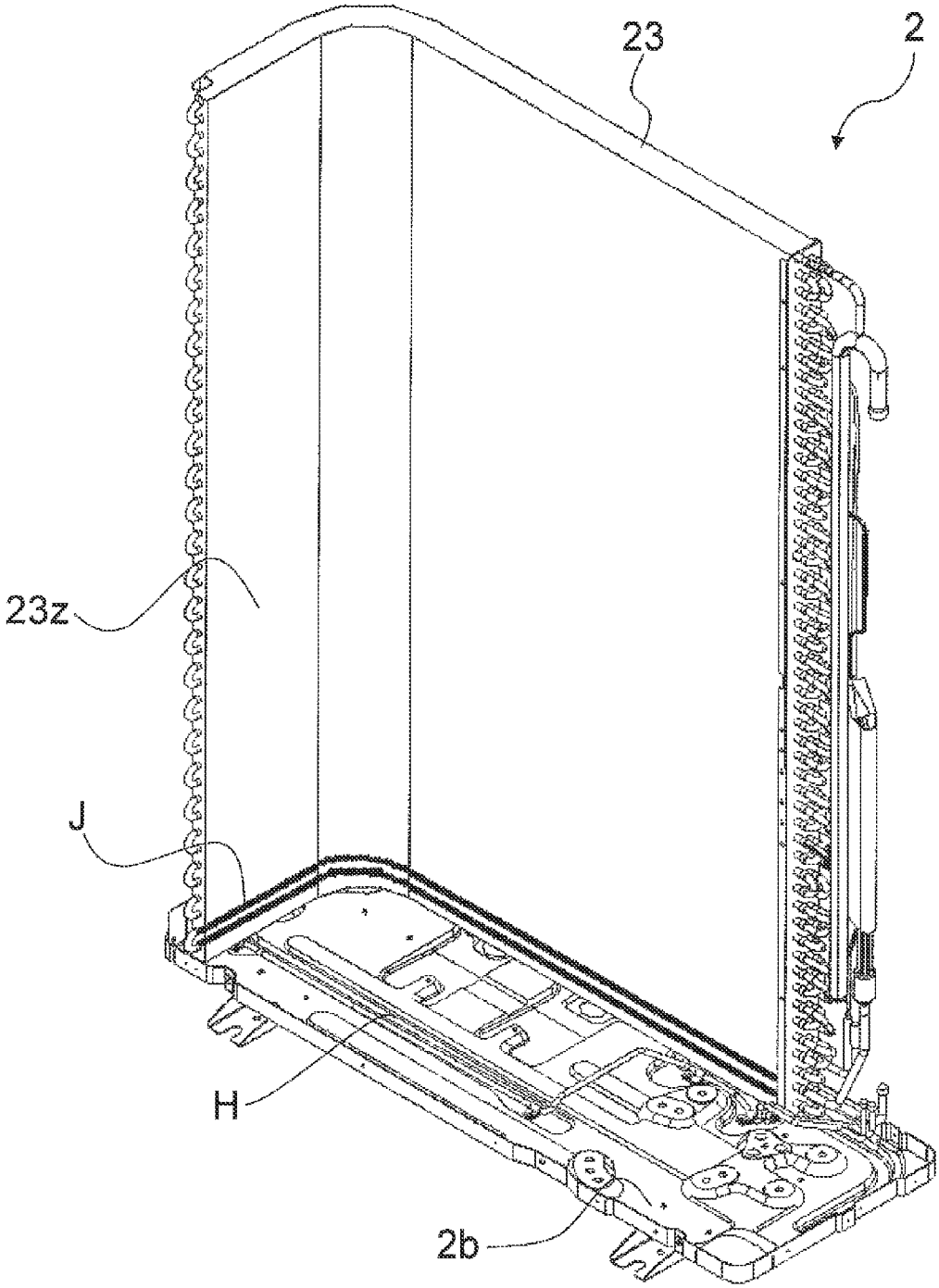
FIG. 4 is a perspective view showing the positional relationship between the outdoor heat exchanger and the bottom plate of the outdoor unit.
Figure 5:
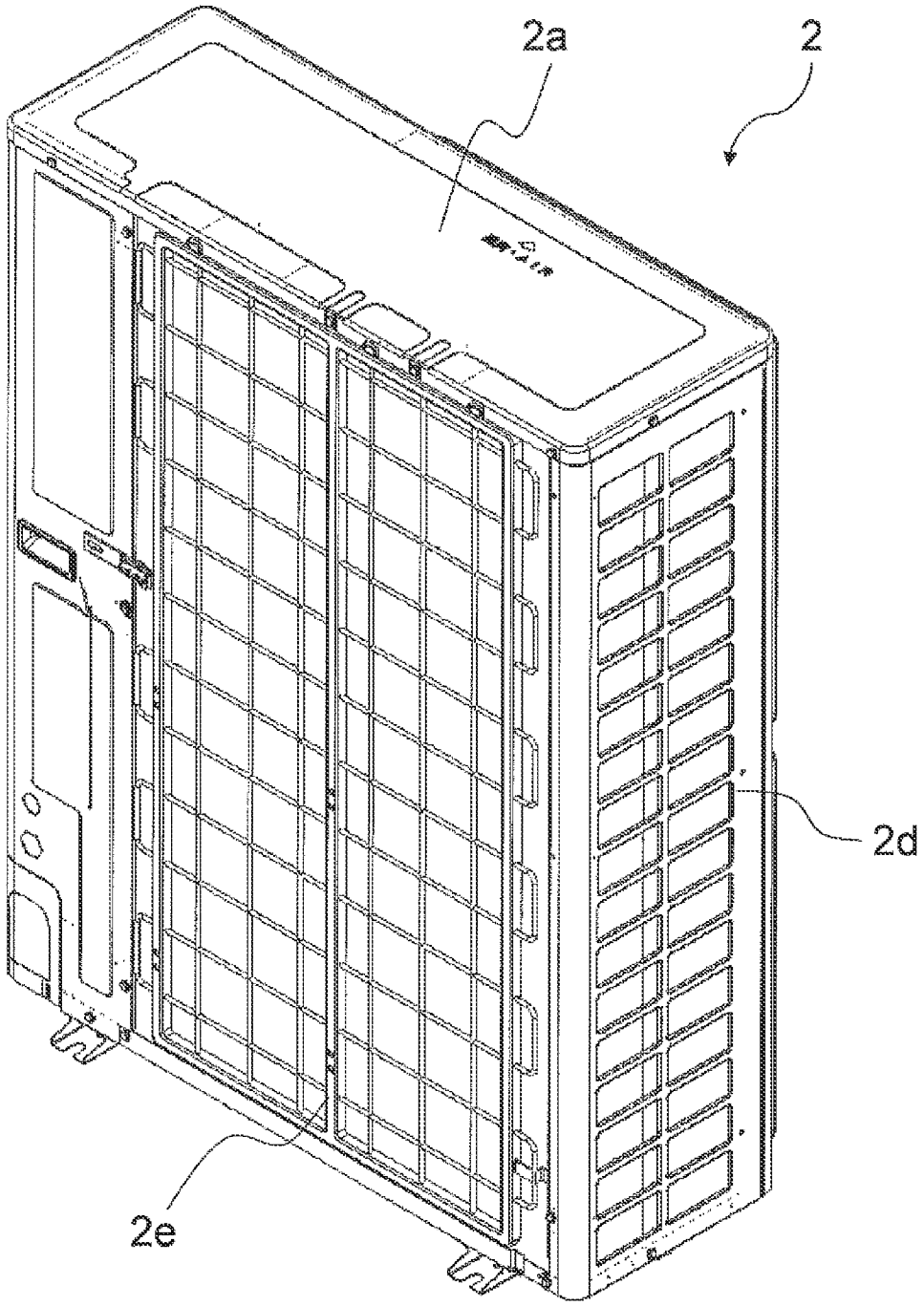
FIG. 5 is an external perspective view showing the back surface of the outdoor unit.

FIG. 2 is an external perspective view showing the front side of the outdoor unit 2. FIG. 3 is an external perspective view showing the back side of the outdoor unit 2. FIG. 4 is a perspective view showing the positional relationship between the outdoor heat exchanger 23 and the outdoor fans 26. FIG. 5 is a perspective view showing the positional relationship between the outdoor heat exchanger 23 and a bottom plate 2*b*.

The external surfaces of the outdoor unit 2 are formed by a substantially rectangular column-shaped outdoor-unit casing composed of a top plate 2*a*, a bottom plate 2*b*, a front panel 2*c*, a left-side panel 2*d*, a right-side panel 2*f*, and a back panel 2*e*.

The outdoor unit 2 is divided via a partitioning plate 2*h* (refer to FIG. 19, etc.) into a blower chamber on the side of the left-side panel 2*d*, in which the outdoor heat exchanger 23, outdoor fans 26, and other components are disposed, and a mechanical chamber on the side of the right-side panel 2*f*, in which the compressor 21 and the electromagnetic induction heating unit 6 are disposed. The electromagnetic induction heating unit 6 is disposed in the mechanical chamber at an upper position in the vicinity of the left-side panel 2*d* and the top plate 2*a*. The plurality of heat exchange fins 23*z* of the outdoor heat exchanger 23 described above are arranged in the plate thickness direction so that the plate thickness direction is substantially horizontal. The juncture tube J is arranged by passing through the heat exchange fins 23*z* in the thickness direction thereof in the lowest portion of the heat exchange fins 23*z* of the outdoor heat exchanger 23. The hot-gas bypass circuit H is disposed below the outdoor fans 26 and along the bottom of the outdoor heat exchanger 23.

<1-3> Electromagnetic Induction Heating Unit 6

Figure 6:
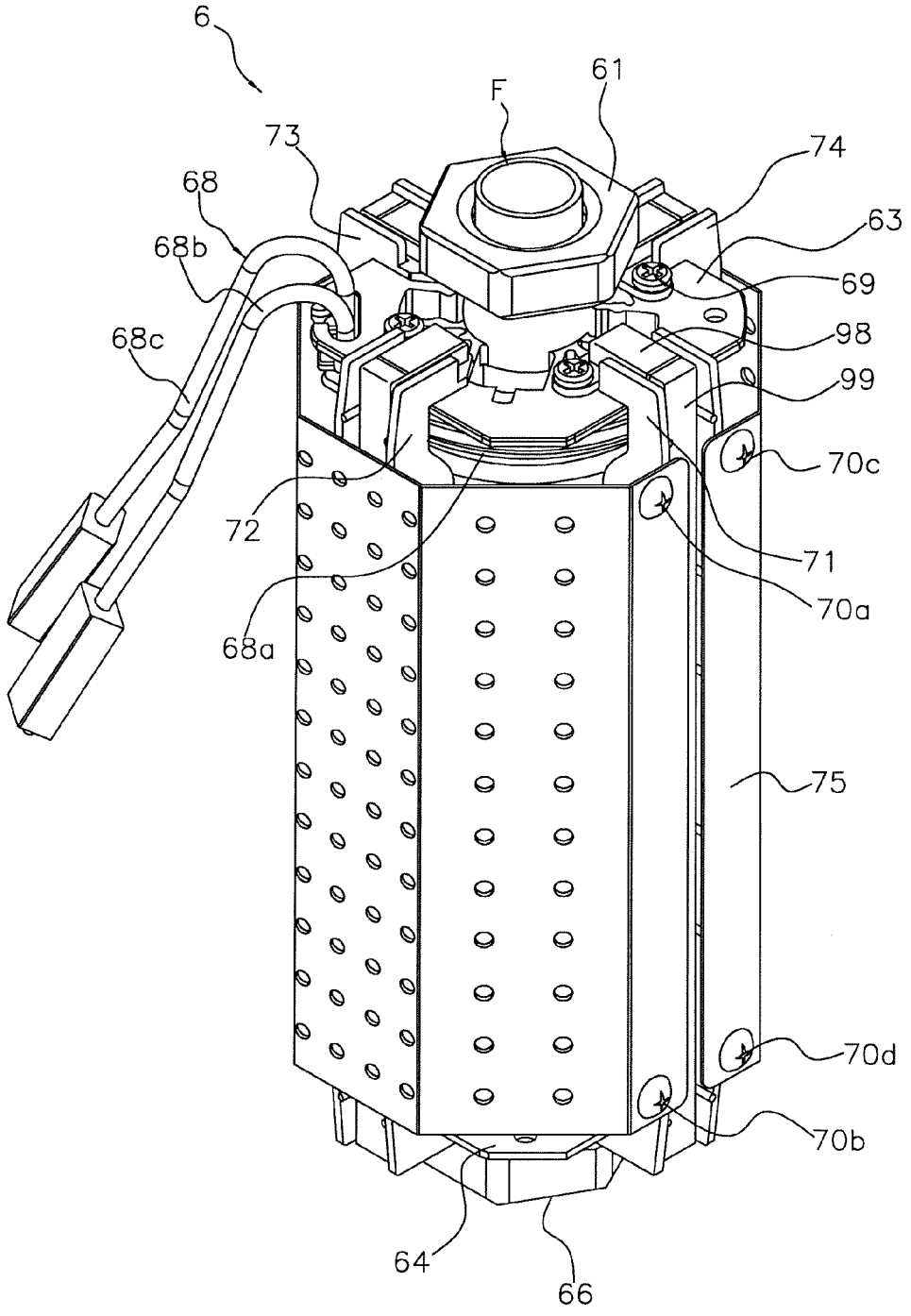
FIG. 6 is an external perspective view showing the electromagnetic induction heating unit.
Figure 7:
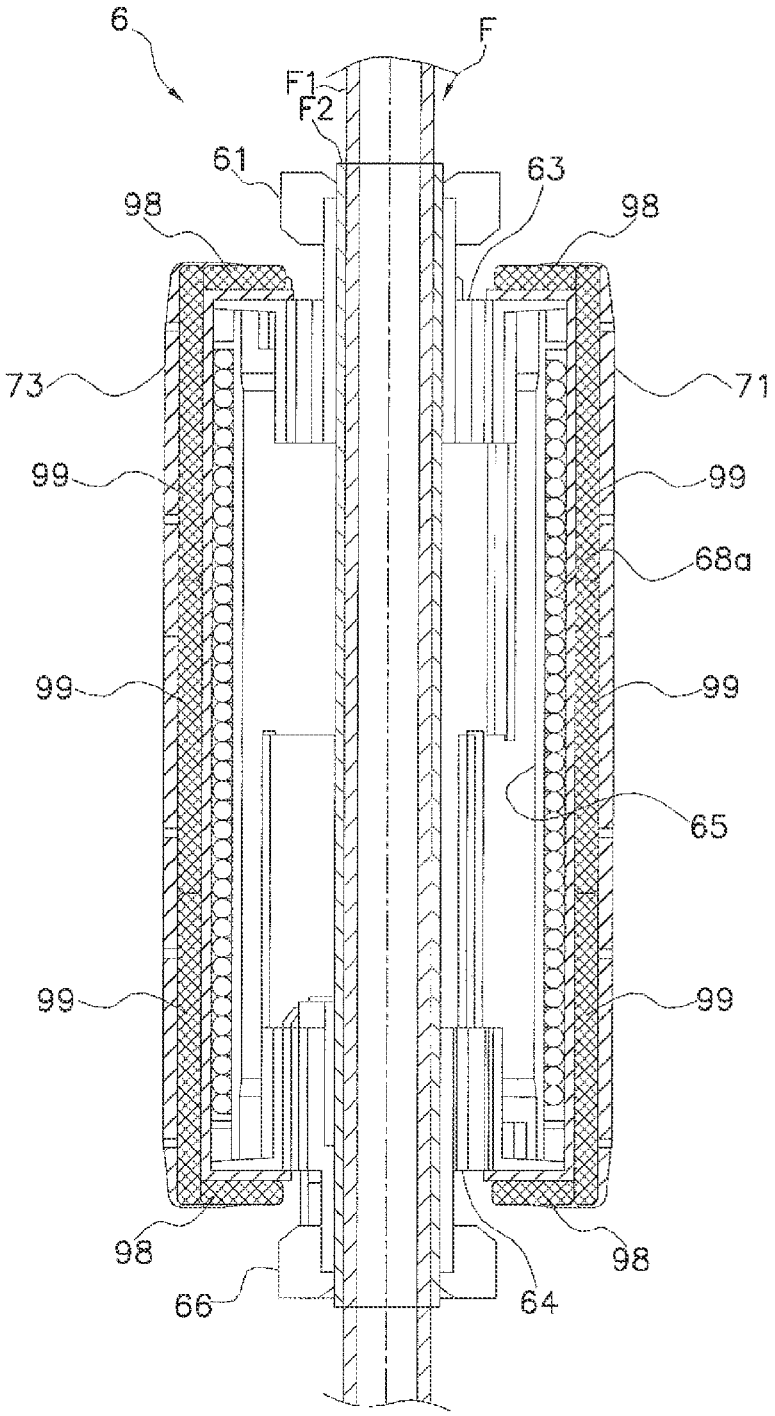
FIG. 7 is a sectional view showing the configuration of the electromagnetic induction heating unit.
Figure 8:
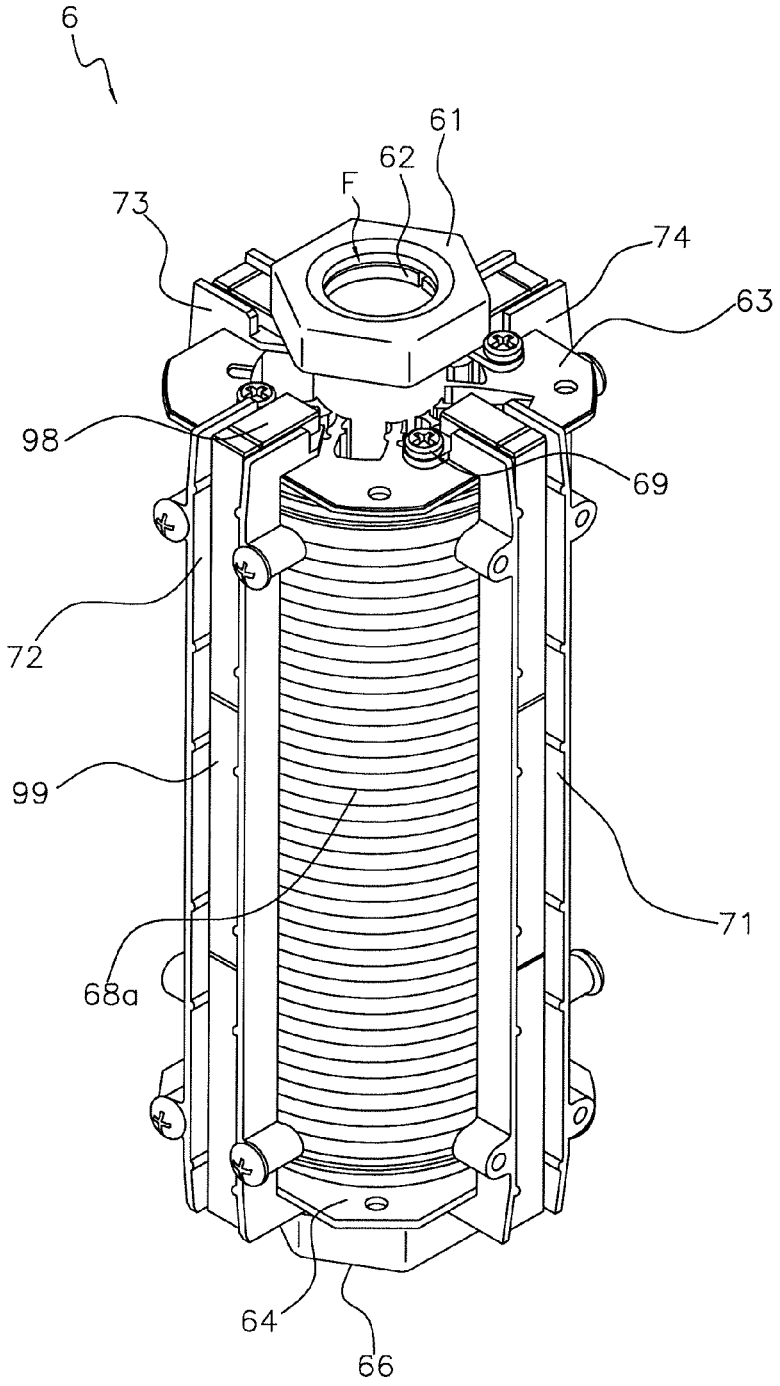
FIG. 8 is an external perspective view showing a state in which the screen cover is removed from the electromagnetic induction heating unit.

FIG. 6 is a rough perspective view showing the electromagnetic induction heating unit 6. FIG. 7 is a sectional view showing the electromagnetic induction heating unit 6. FIG. 8 is an external perspective view showing a state in which the screen cover 75 is removed from the electromagnetic induction heating unit 6.

Figure 11:
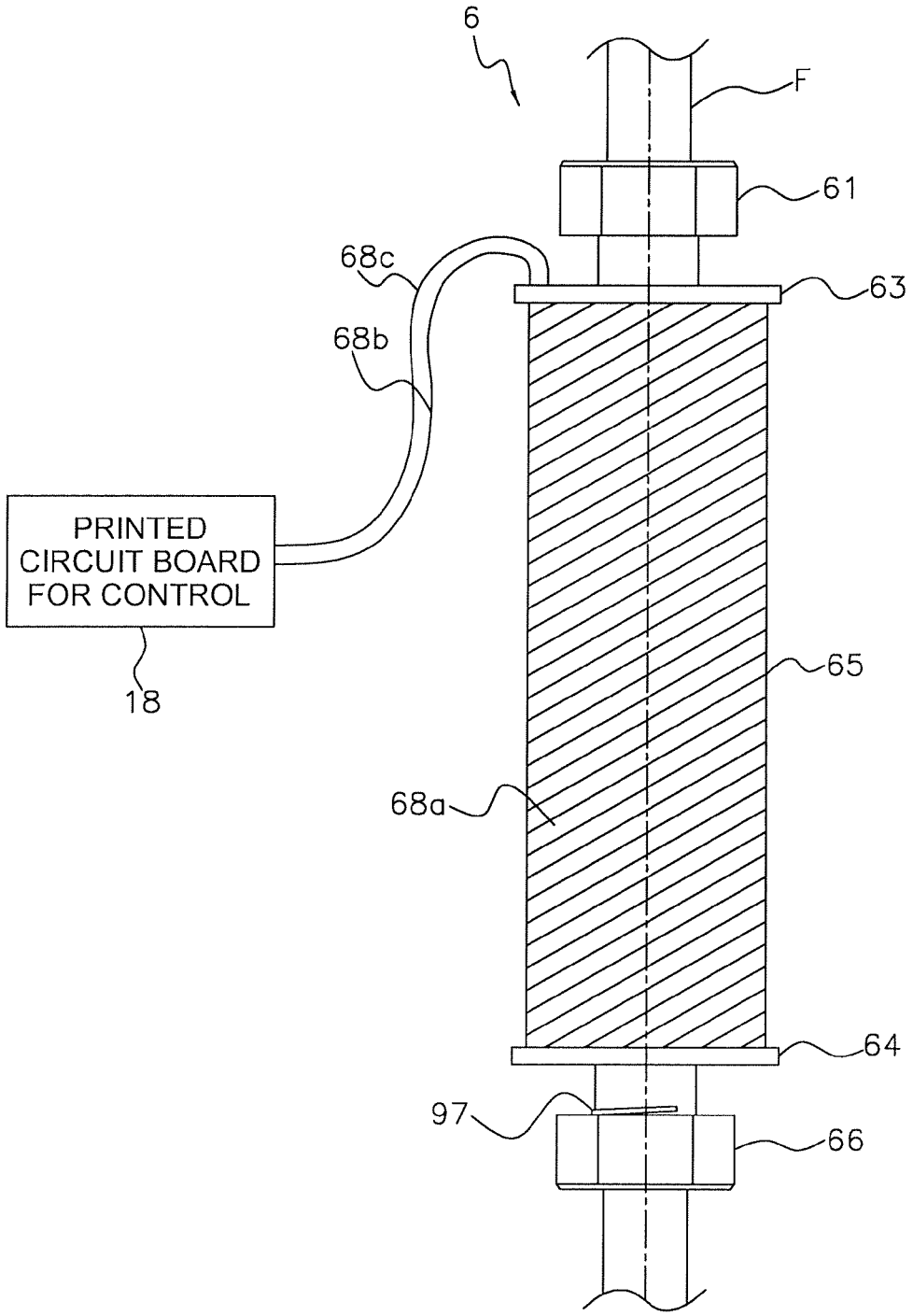
FIG. 11 is a conceptual view showing the supply of power to the electromagnetic induction heating unit.

The electromagnetic induction heating unit 6 is provided so as to cover the heated portion of the accumulator tube F from the outside in the radial direction thereof, and heats the heated portion by electromagnetic induction heating. The heated portion of the accumulator tube F has a two-layer tubing structure which has copper tubing F1 on the inside and SUS tubing F2 on the outside thereof. Before the electromagnetic induction heating unit 6 is fixed to the accumulator tube F, a binding 97 such as the one shown in FIG. 11 is used to position the electromagnetic induction heating unit 6 with respect to the accumulator tube F. The operation of fixing can thereby be performed while the electromagnetic induction heating unit 6 is in position with respect to the accumulator tube F, and workability is enhanced.

The electromagnetic induction heating unit 6 is provided with a first hexagonal nut 61, a second hexagonal nut 66, a C-ring 62, a first bobbin lid 63, a second bobbin lid 64, a bobbin main body 65, a first ferrite case 71, a second ferrite case 72, a third ferrite case 73, a fourth ferrite case 74, a first ferrite 98, a second ferrite 99, a coil 68, a screen cover 75, a thermistor 14, and a fuse 15.

The first hexagonal nut 61 is made of resin, and fixes the electromagnetic induction heating unit 6 in the vicinity of the top end of the accumulator tube F. The second hexagonal nut 66 is made of resin, and fixes the electromagnetic induction heating unit 6 in the vicinity of the bottom end of the accumulator tube F.

The C-ring 62 is made of resin, and is fixed in surface contact with the accumulator tube F in cooperation with the first hexagonal nut 61 and the first bobbin lid 63. Although not shown in the drawing, the C-ring 62 is also fixed in surface contact with the accumulator tube F in cooperation with the second hexagonal nut 66 and the second bobbin lid 64.

Figure 13:
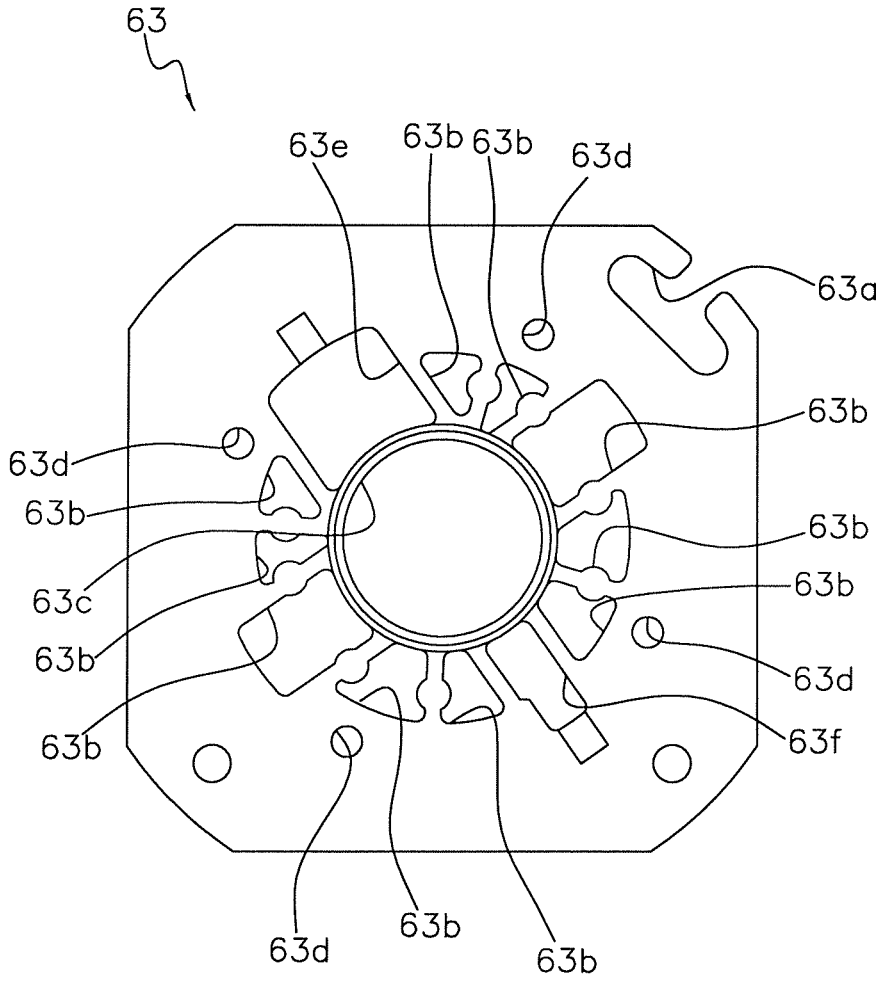
FIG. 13 is a top view showing the portion positioned on the outside of the first bobbin lid.
Figure 14:
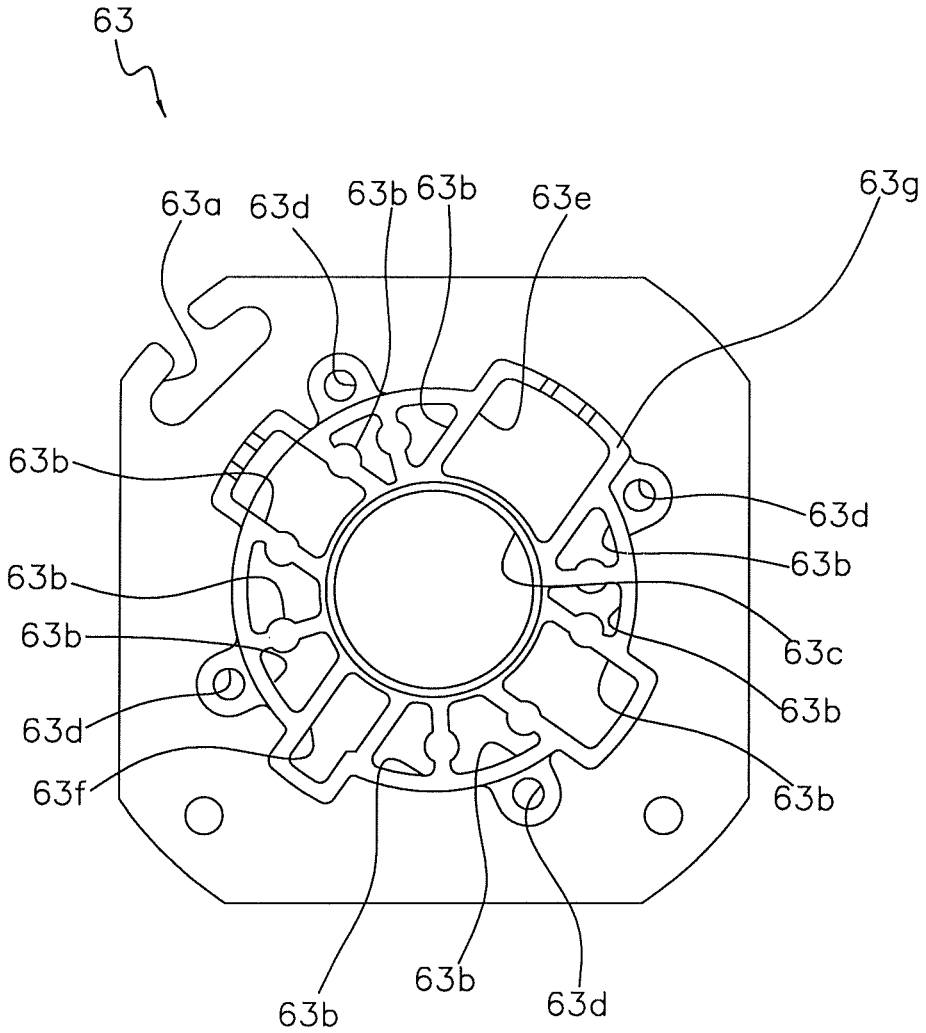
FIG. 14 is a bottom view showing the portion positioned on the inside of the first bobbin lid.

The first bobbin lid 63 is made of resin, is one of the members for determining the relative positioning of the accumulator tube F and the coil 68 in the electromagnetic induction heating unit 6, and covers the accumulator tube F from the periphery thereof above the electromagnetic induction heating unit 6. The second bobbin lid 64 is made of resin, has the same shape as the first bobbin lid 63, and covers the accumulator tube F from the periphery thereof below the electromagnetic induction heating unit 6. FIG. 13 is a top view showing the first bobbin lid 63. FIG. 14 is a bottom view showing the first bobbin lid 63. The first bobbin lid 63 has a cylindrical part 63*c* for the tube, for fixing the accumulator tube F and the electromagnetic induction heating unit 6 in cooperation with the first hexagonal nut 61 and the C-ring 62 while allowing the accumulator tube F to pass through. The first bobbin lid 63 has a substantially T-shaped hook-shaped part 63*a* formed toward the inside from the external peripheral portion, for retaining a coil first portion 68*b* and a coil second portion 68*c* while allowing the coil first portion 68*b* and coil second portion 68*c* to pass through. The first bobbin lid 63 has a plurality of radiating openings 63*b* which run through in the vertical direction in order to dissipate heat that accumulates between the bobbin main body 65 and the SUS tubing F2 to the outside. The first bobbin lid 63 has four screw holes 63*d* for screws 69, for screwing the first through fourth ferrite cases 71 through 74 via the screws 69. The first bobbin lid 63 also has a fuse insertion opening 63*e* and a thermistor insertion opening 63*f*. The fuse insertion opening 63*e* is an opening used for attaching the fuse 15 shown in FIG. 16, and has a shape which conforms to the outer edge shape of the fuse 15 as viewed in the insertion direction thereof. The thermistor insertion opening 63*f* is an opening used for attaching the thermistor 14 shown in FIG. 15, and has a shape which conforms to the outer edge shape of the thermistor 14 as viewed in the insertion direction thereof. Since the thermistor 14 and the fuse 15 are attached from below the electromagnetic induction heating unit 6, the thermistor insertion opening 63*f* and fuse insertion opening 63*e* of the first bobbin lid 63 perform the same radiating function as the radiating openings 63*b*. Since the warm air to be radiated accumulates in the upper space inside the bobbin main body 65, providing more radiating openings at the top than at the bottom enables efficient heat dissipation. The thermistor 14 is inserted in the thermistor insertion opening 63*f* of the second bobbin lid 64, the fuse 15 is inserted in the fuse insertion opening 63*e* of the second bobbin lid 64, and the thermistor 14 and fuse 15 are each attached. As shown in FIG. 14, on the bottom side of the first bobbin lid 63, a bobbin cylinder top part 63*g* extends downward for fitting with the bobbin main body 65 by being positioned on the inside of a top end cylindrical part (described hereinafter) of the bobbin main body 65. So as not to close the passage state of the radiating openings 63*b*, screw holes 63*d*, fuse insertion opening 63*e*, and thermistor insertion opening 63*f* described above, the bobbin cylinder top part 63*g* is formed so as to extend in the passage direction from a portion that conforms to the outer edges of each opening. The openings and shape of the first bobbin lid 63 are the same as in the second bobbin lid 64, the reference numerals beginning with 63 for each member of the first bobbin lid 63 correspond to the reference numerals beginning with 64 for each member of the second bobbin lid 64, and no further description of these corresponding members will be given. The second bobbin lid 64 also has a tube cylinder top part 64*c* (see FIG. 7), the same as the first bobbin lid 63, and the cylinder top part 64*c* fits with a bottom end cylindrical part (described hereinafter) of the bobbin main body 65.

Figure 9:
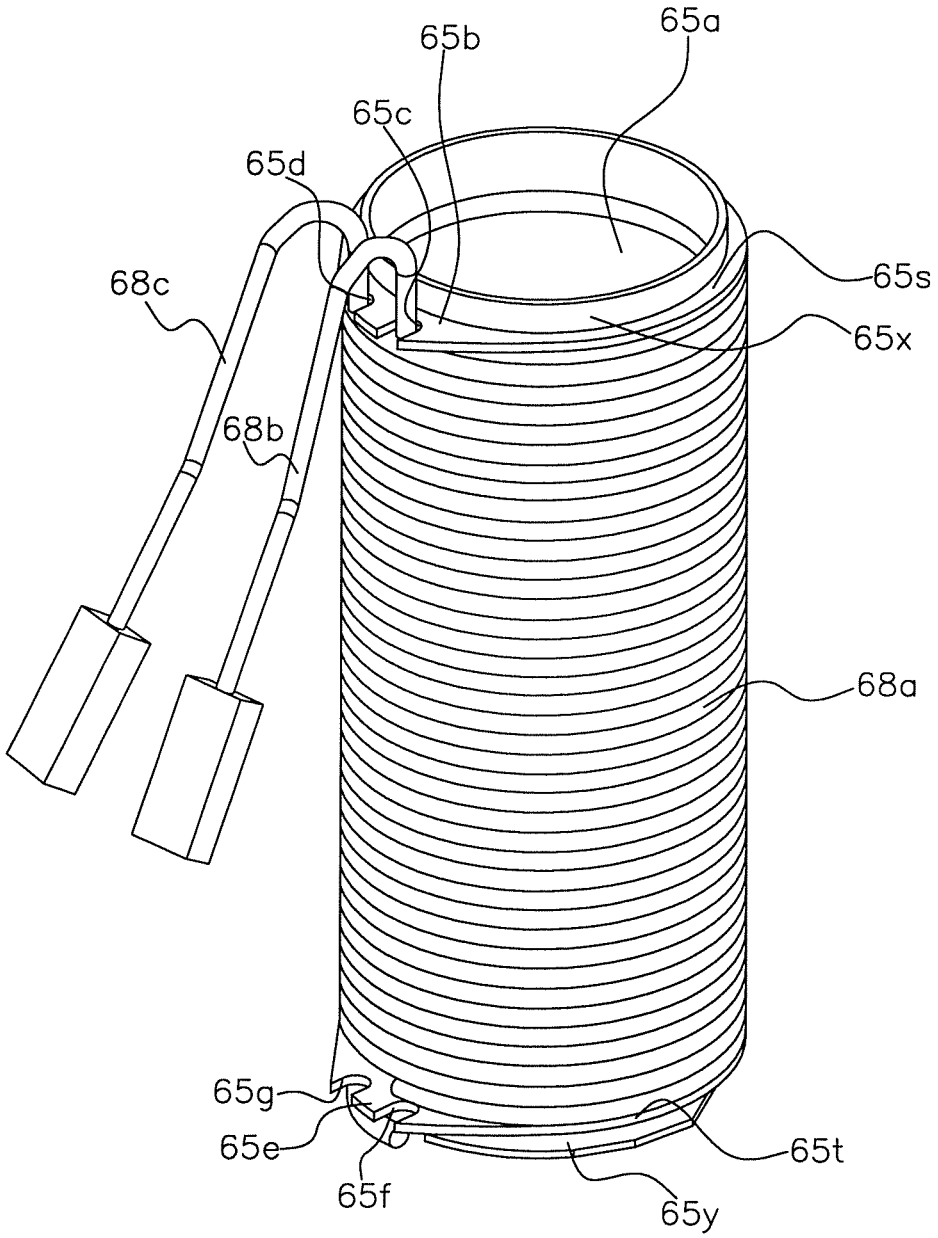
FIG. 9 is an external perspective view showing the bobbin main body on which the coil is wound.
Figure 10:
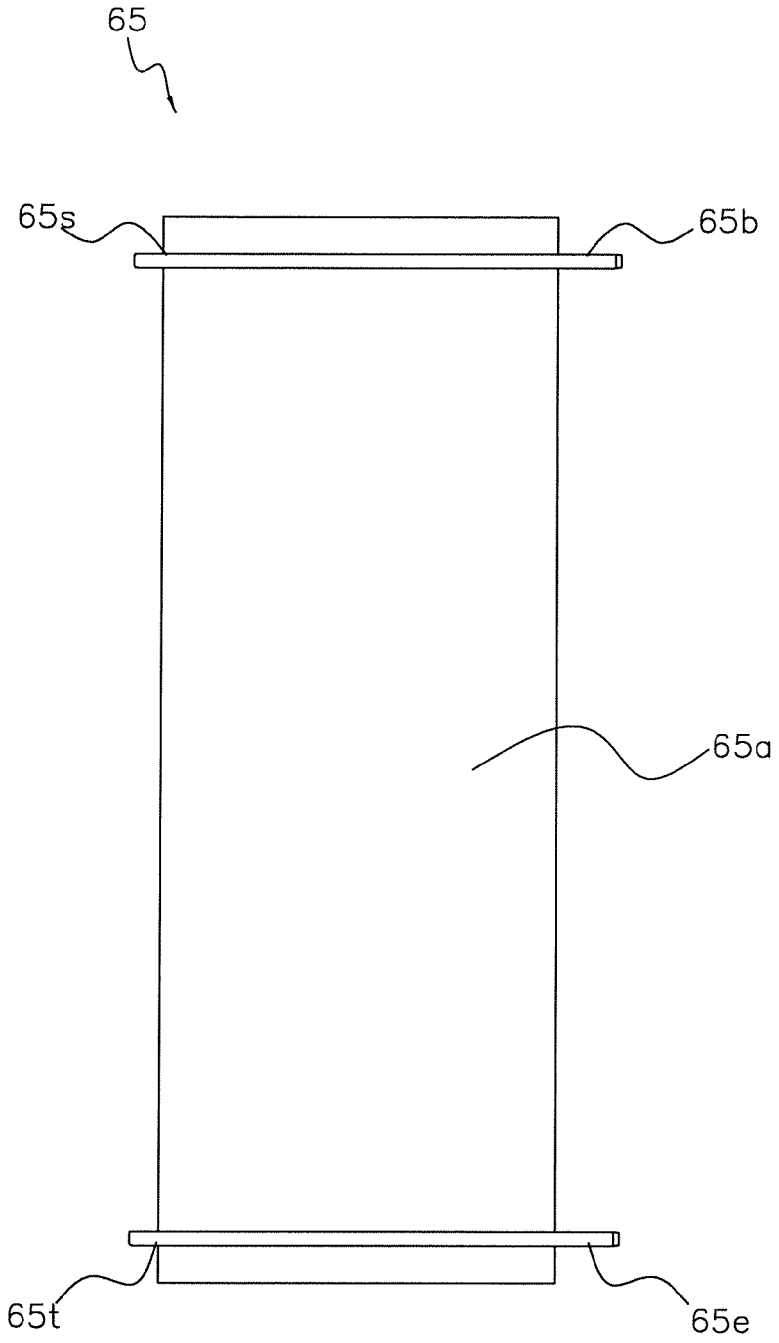
FIG. 10 is a front view showing the bobbin main body.

The coil 68 is wound around the bobbin main body 65, as shown in perspective figure of FIG. 9. As shown in FIG. 10, the bobbin main body 65 has a cylindrical part 65*a* having a cylindrical shape. The bobbin main body 65 has a first winding stop 65*s* formed so as to protrude in the radial direction at a portion slightly lower than the top end, and a second winding stop 65*t* formed so as to protrude in the radial direction at a portion slightly higher than the bottom end. A top end cylindrical part 65*x* extends upward from the first winding stop 65*s*. A bottom end cylindrical part 65*y* extends downward from the second winding stop 65*t*. The first winding stop 65*s* has a first coil retaining part 65*b* that protrudes further outward in the radial direction. The first coil retaining part 65*b* has a coil retaining groove 65*c* formed as an indentation in the radial direction to hold the coil first portion 68*b* therein, and a coil retaining groove 65*d* formed as an indentation in the radial direction to hold the coil second portion 68*c* therein. The second winding stop 65*t* has a second coil retaining part 65*e* in which coil retaining grooves 65*f*, 65*g* are formed, in the same manner as in the first winding stop 65*s*. As shown in the bottom view of the electromagnetic induction heating unit 6 in FIG. 12, the outsides of the coil retaining grooves 65*f*, 65*g* formed in the bobbin main body 65 are covered by a hook-shaped part 64*a* of the second bobbin lid 64, and the coil first portion 68*b* and coil second portion 68*c* can thereby be more reliably retained. Since the coil retaining grooves 65*f*, 65*g* and the hook-shaped part 64*a* are offset in the direction in which the accumulator tube F extends, the coil first portion 68*b* and the coil second portion 68*c* can be retained at a plurality of locations in the extension direction thereof. Localized loads on the coil 68 can therefore be made less prone to occur. In the bobbin main body 65, a space is formed between the bobbin main body 65 and the accumulator tube F on the inside toward the accumulator tube F, and a distance is provided so that the magnetic flux that forms when current is fed to the coil 68 more efficiently passes through the SUS tubing F2 of the accumulator tube F.

Figure 12:
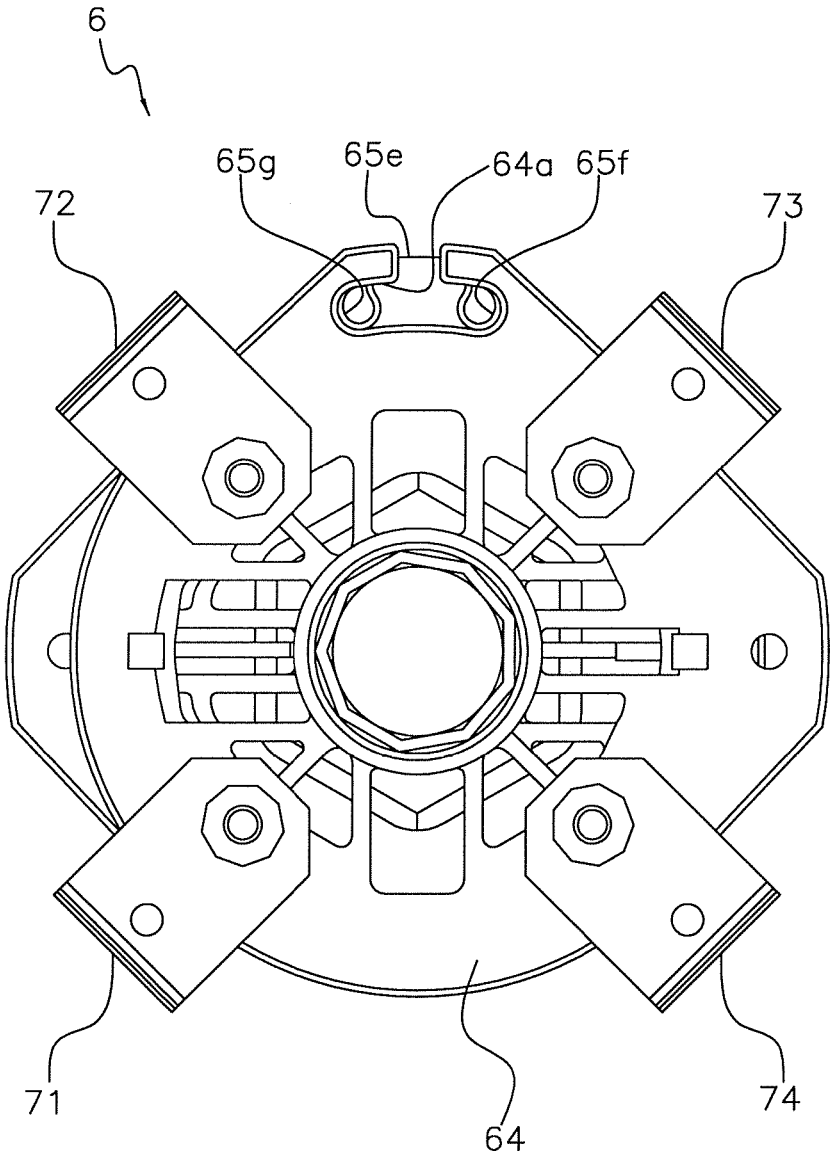
FIG. 12 is a bottom view showing a state in which the screen cover of the electromagnetic induction heating unit is removed.

The first ferrite case 71 holds the first bobbin lid 63 and the second bobbin lid 64 from the direction in which the accumulator tube F extends. The first ferrite case 71 has a portion for accommodating the first ferrite 98 and second ferrite 99 described hereinafter. The second ferrite case 72, third ferrite case 73, and fourth ferrite case 74 are the same as the first ferrite case 71, and are disposed in positions so as to cover the bobbin main body 65, first bobbin lid 63, and second bobbin lid 64 from the outside in four directions. As shown in FIGS. 6, 8, and 12, the first bobbin lid 63 is screwed via metal screws 69 and fixed to each of the first through fourth ferrite cases 71 through 74.

Figure 17:
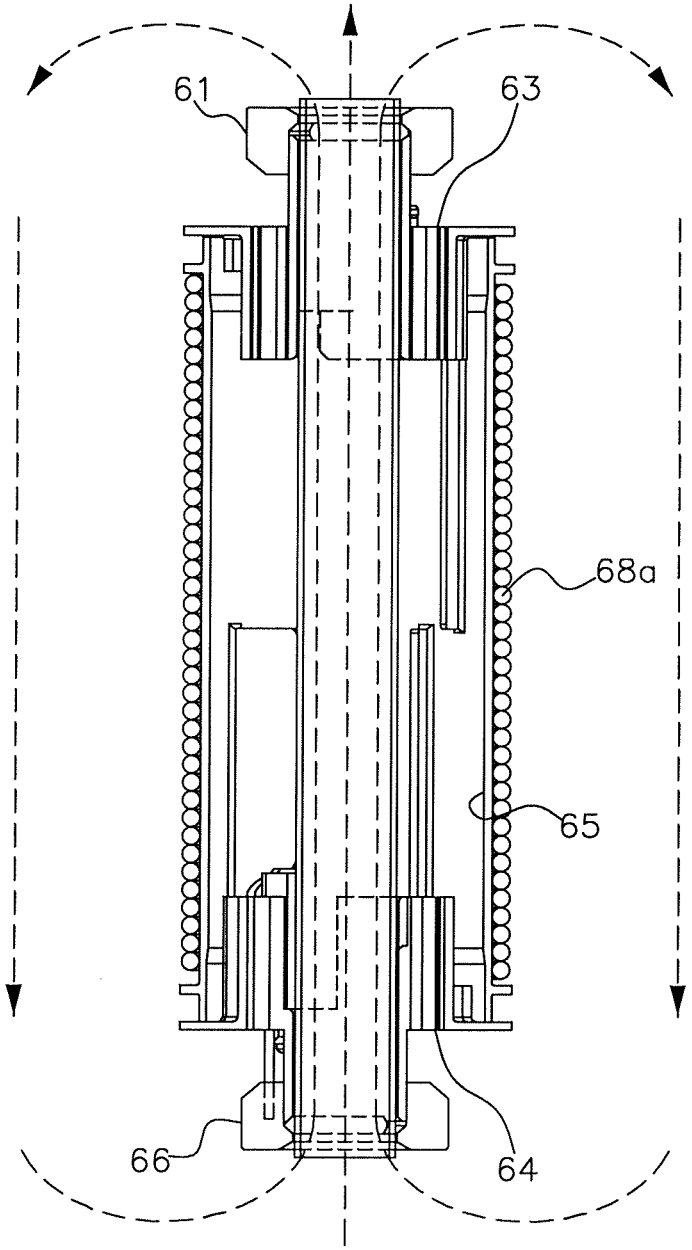
FIG. 17 is a view showing the magnetic flux that occurs in a state in which the screen cover is absent.
Figure 18:
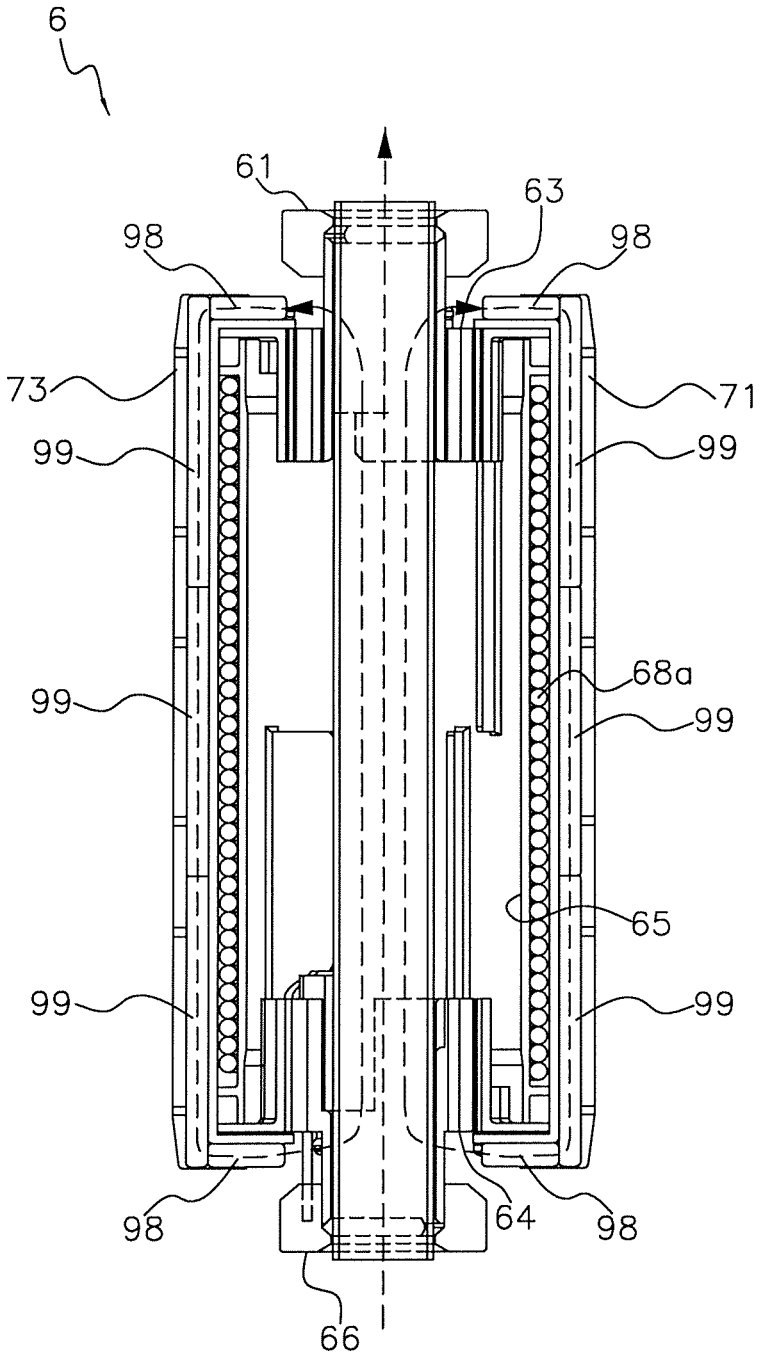
FIG. 18 is a view showing the magnetic flux that occurs in a state in which the screen cover is provided.

The first ferrite 98 is composed of a ferrite material having high magnetic permeability, and when current is fed to the coil 68, the first ferrite 98 collects the magnetic flux that occurs in portions outside the SUS tubing F2 as well and forms a path for the magnetic flux. The first ferrite 98 is accommodated particularly in the accommodating parts of the first through fourth ferrite cases 71 through 74 near the top and bottom ends of the electromagnetic induction heating unit 6. The second ferrite 99 is the same as the first ferrite 98, other than with respect to the position and shape thereof, and is disposed at a position near the outside of the bobbin main body 65 in the accommodating parts of the first through fourth ferrite cases 71 through 74. In a case in which the first ferrite 98 and second ferrite 99 are not provided, the magnetic flux leaks out on the periphery as shown in FIG. 17, for example. In the electromagnetic induction heating unit 6 of the present embodiment, however, since the first ferrite 98 and second ferrite 99 are provided on the outside of the coil 68, the magnetic flux flow as shown in FIG. 18, and leakage flux can be reduced.

The coil 68 has a coil winding portion 68*a* that is helically wound on the outside of the bobbin main body 65 with the extension direction of the accumulator tube F as the axial direction, a coil first portion 68*b* that extends at one end of the coil 68 with respect to the coil winding portion 68*a*, and a coil second portion 68*c* that extends at the other end, on the opposite side from the one end of the coil 68. This coil 68 is positioned inside the first through fourth ferrite cases 71 through 74. The coil first portion 68*b* and the coil second portion 68*c* are connected to a printed circuit board 18 for control, as shown in FIG. 11. The coil 68 receives a high-frequency current fed from the printed circuit board 18 for control. The printed circuit board 18 for control is controlled by the controller 11. When the fed high-frequency current is received, the coil winding portion 68*a* generates a magnetic flux. Specifically, as indicated by dashed lines in FIG. 18, a magnetic flux occurs which is substantially elliptical on the plane extending in the axial direction and in the radial direction with respect to the accumulator tube F, through the portion of the SUS tubing F2 closest to the coil winding portion 68*a*, and the portions of the first ferrite 98, second ferrite 99, and screen cover 75 closest to the coil winding portion 68*a*. The magnetic flux thus formed causes a current (eddy current) to occur by electromagnetic induction in the SUS tubing F2. As a current flows through the SUS tubing F2, heat is evolved in a portion thereof that acts as an electrical resistor. Merely by winding the coil 68 on the outside of the bobbin main body 65, the coil 68 can be placed so that the axial direction thereof is substantially the same as the axial direction of the SUS tubing F2. By providing the coil 68 in a substantially cylindrical shape, more magnetic flux can be supplied to the SUS tubing F2 of the accumulator tube F, and the efficiency of heating can be enhanced. Copper wire, which is a good conductor, is used as the material of the coil 68 herein for the sake of efficiency in generating a magnetic flux. The material of the coil 68 is not particularly limited insofar as the material conducts electricity.

As is apparent by comparing FIG. 6 and FIG. 8, the screen cover 75 is disposed on the outermost peripheral portion of the electromagnetic induction heating unit 6, and collects the magnetic flux that cannot be held in by only the first ferrite 98 and the second ferrite 99. As shown in FIG. 6, the screen cover 75 is screwed and fixed to the first ferrite case 71 via screws 70*a*, 70*b*, 70*c*, 70*d*. Through this configuration, there is almost no leakage flux on the outside of the screen cover 75 in the electromagnetic induction heating unit 6, and the areas in which magnetic flux occurs can be self-determined.

Figure 15:
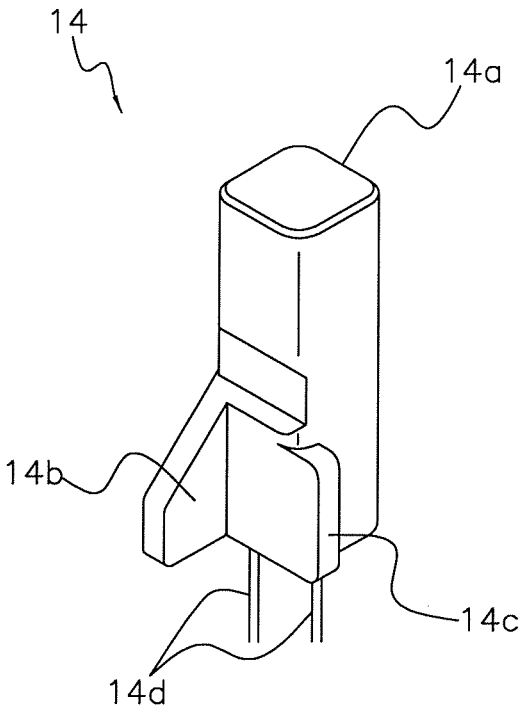
FIG. 15 is an external perspective view showing the thermistor.

As shown in FIG. 15, the thermistor 14 is attached so as to be in direct contact with the external surface of the accumulator tube F, and the thermistor 14 has a thermistor detector 14*a*, an outside protrusion 14*b*, a lateral protrusion 14*c*, and thermistor wires 14*d*. The thermistor detector 14*a* is shaped so as to conform to the curved shape of the external surface of the accumulator tube F, and has a surface area of substantial contact. The outside protrusion 14*b* is a protrusion which protrudes in the direction away from the accumulator tube F in a state in which the thermistor 14 is attached, and the shape of the outside protrusion 14*b* conforms to the edge of the thermistor insertion opening 63*f* of the second bobbin lid 64. The lateral protrusion 14*c* is also shaped so as to conform to the edge of the thermistor insertion opening 63*f* of the second bobbin lid 64 in the same manner as the outside protrusion 14*b*, and the lateral protrusion 14*c* extends away from the outside protrusion 14*b*. The thermistor wires 14*d* transmit the detection result of the thermistor detector 14*a* as a signal to the controller 11. The thermistor 14 is inserted upward in FIG. 15, but because the thermistor 14 has the outside protrusion 14*b* and the lateral protrusion 14*c*, the thermistor 14 has an asymmetrical shape as viewed from the insertion direction, the same as the thermistor insertion opening 63*f*. Errors can therefore be prevented in the attachment of the thermistor 14, and attachment workability is enhanced.

Figure 16:
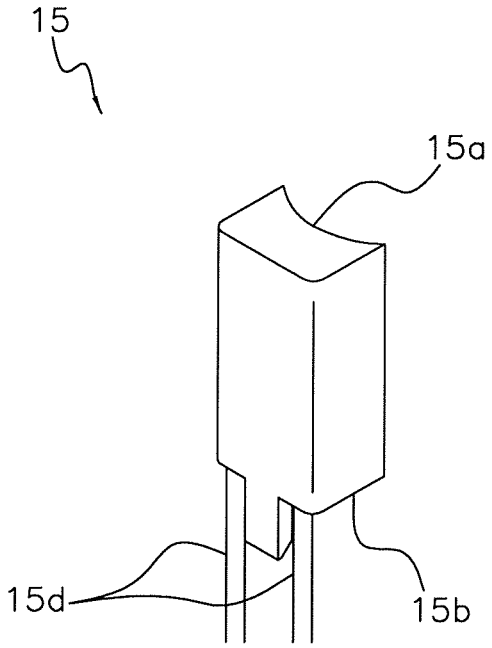
FIG. 16 is an external perspective view showing the fuse.

As shown in FIG. 16, the fuse 15 is attached so as to be in direct contact with the external surface of the accumulator tube F, and has a fuse detector 15*a*, an asymmetrical shape 15*b*, and fuse wires 15*d*. The fuse detector 15*a* has an indented shape which is curved so as to conform to the curved shape of the external surface of the accumulator tube F, and the fuse detector 15*a* has a surface area of substantial contact. The asymmetrical shape 15*b* is inserted upward in FIG. 16, the same as the thermistor 14 described above, but has an asymmetrical shape as viewed from the insertion direction, the same as the fuse insertion opening 63*e*. Errors can therefore be prevented in the attachment of the fuse 15, and attachment workability is enhanced. The fuse wires 15*d* are also connected to the controller 11. When the fuse 15 detects a temperature above a predetermined temperature, the controller 11 initiates control for stopping the supply of power to the coil 68.

<1-4> Internal Structure of the Outdoor Unit 2

Figure 19:
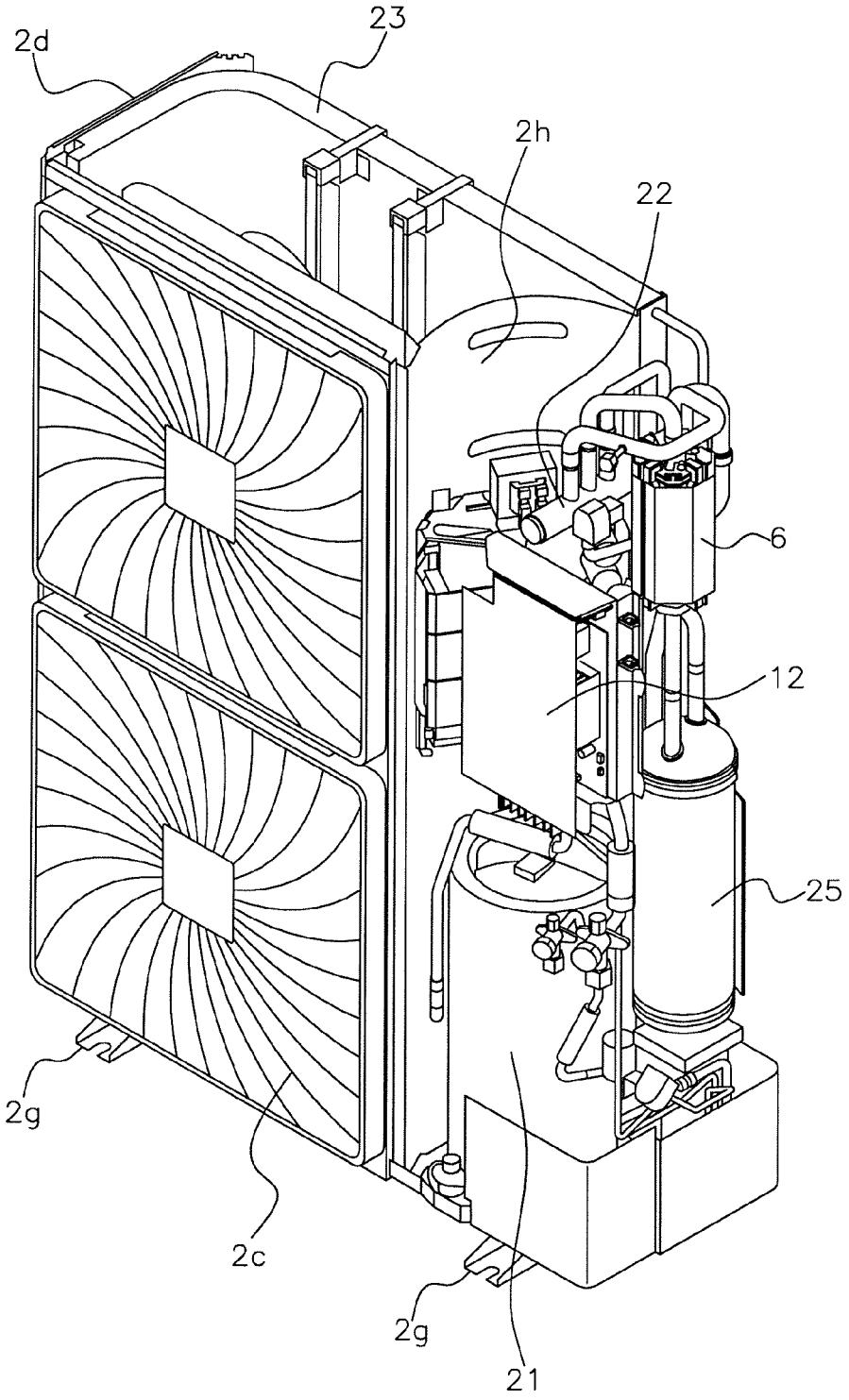
FIG. 19 is an overall front perspective view showing the internal structure of the mechanical chamber of the outdoor unit.
Figure 20:
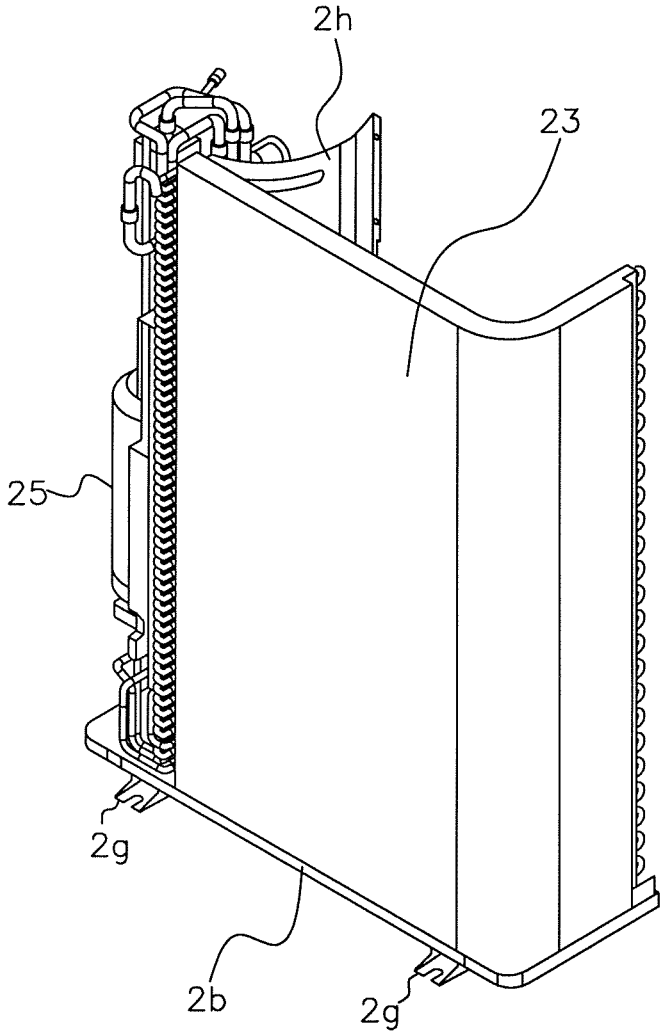
FIG. 20 is an overall rear perspective view showing the internal structure of the outdoor unit.
Figure 21:
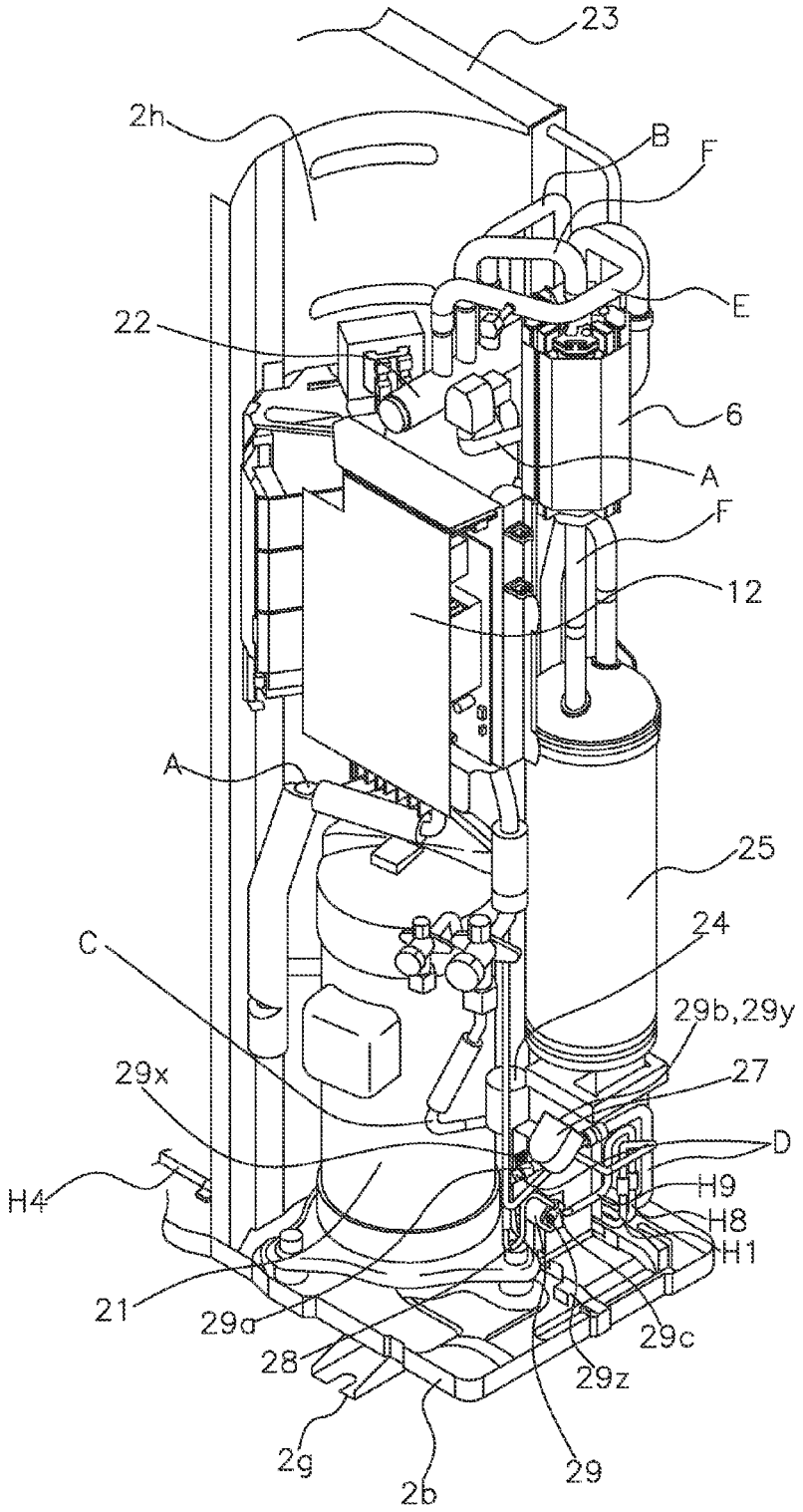
FIG. 21 is a perspective view showing the internal structure of the mechanical chamber of the outdoor unit.
Figure 23:
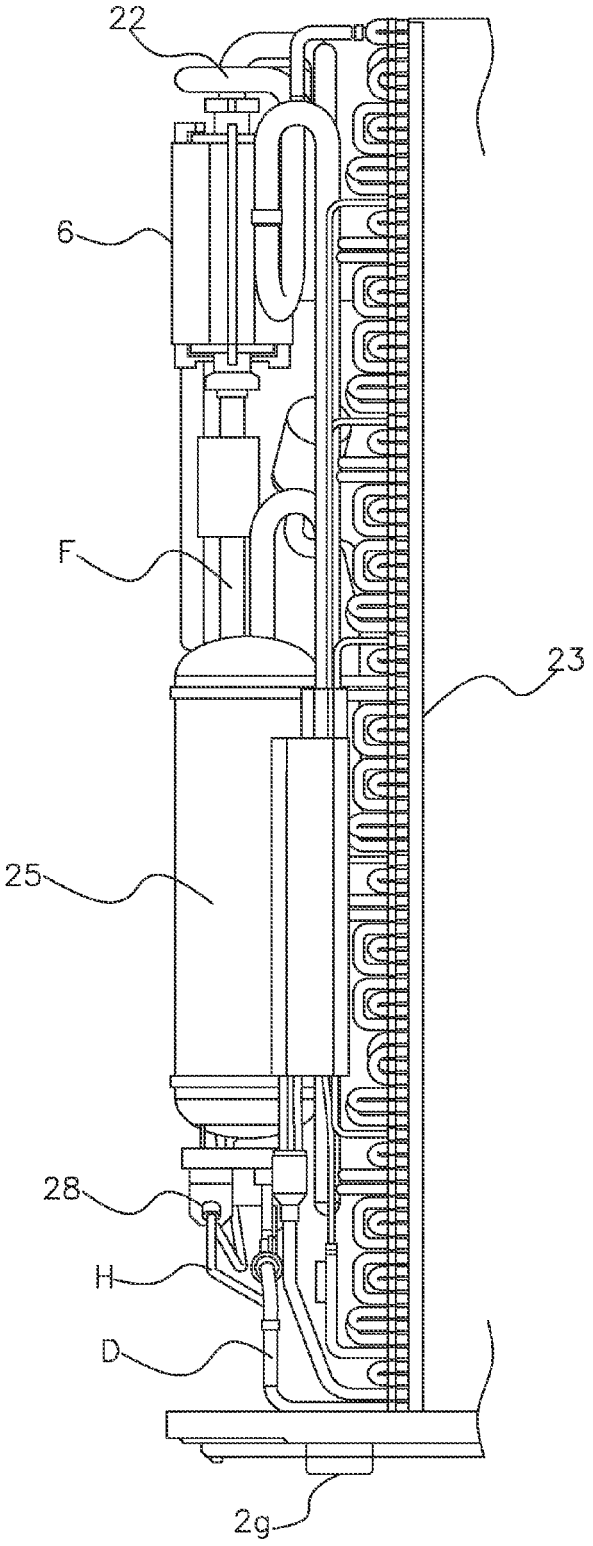
FIG. 23 is a back view showing the mechanical chamber of the outdoor unit.

FIG. 18 is an overall front perspective view showing the internal structure of the mechanical chamber of the outdoor unit 2. FIG. 19 is an overall rear perspective view showing the internal structure of the outdoor unit 2. FIG. 20 is a perspective view showing the internal structure of the mechanical chamber of the outdoor unit 2. FIG. 21 is a right-side view showing the internal structure of the mechanical chamber of the outdoor unit 2. FIG. 23 is a back view showing the mechanical chamber of the outdoor unit 2.

As shown in FIGS. 18 and 19, the outdoor unit 2 has a partition panel 2*h* that extends from front to rear between the top end and the bottom end so as to form a partition between a blower chamber in which the outdoor heat exchanger 23, the outdoor fans 26, and other components are arranged, and a mechanical chamber in which the electromagnetic induction heating unit 6, the compressor 21, the accumulator 25, and other components are arranged. The outdoor unit 2 is screwed to the bottom plate 2*b* and thereby fixed, and the outdoor unit 2 has outdoor unit support stages 2*g* which constitute the lowermost end portions of the outdoor unit 2 on the right and left sides thereof.

The compressor 21 and the accumulator 25 are disposed in the space below the mechanical chamber of the outdoor unit 2. The electromagnetic induction heating unit 6, the four-way switching valve 22, and the outdoor controller 12 are disposed in the upper space of the mechanical chamber of the outdoor unit 2, in the space above the compressor 21, accumulator 25, and other components.

Figure 22:
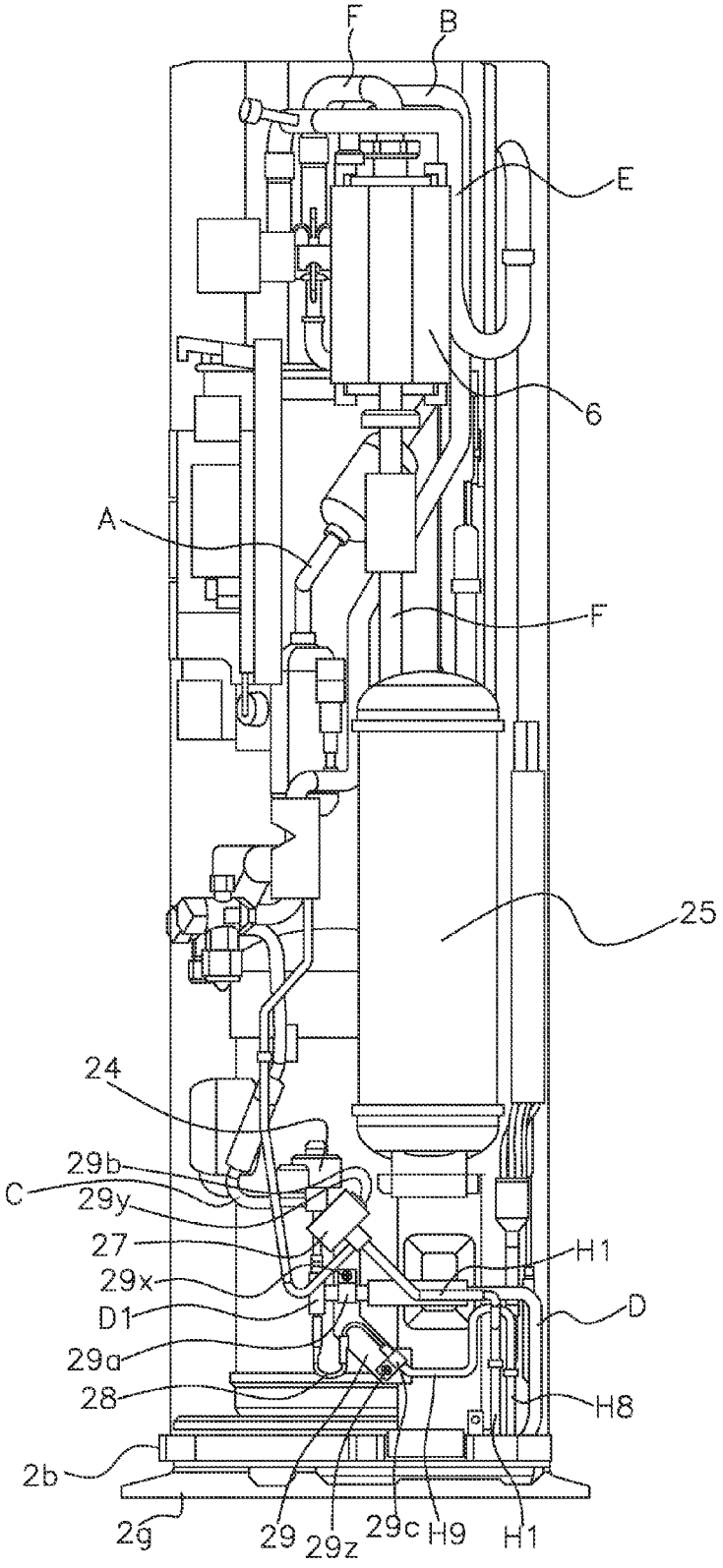
FIG. 22 is a right-side view showing the internal structure of the mechanical chamber of the outdoor unit.

As shown in FIGS. 21, 22, and 23, the compressor 21, four-way switching valve 22, outdoor heat exchanger 23, outdoor motor-driven expansion valve 24, accumulator 25, hot-gas bypass valve 27, capillary tube 28, and electromagnetic induction heating unit 6 disposed in the mechanical chamber as functional elements that constitute the outdoor unit 2 are connected via the discharge tube A, the indoor-side gas tube B, the outdoor-side liquid tube D, the outdoor-side gas tube E, the accumulator tube F, the hot-gas bypass circuit H, and other tubes in order to form the refrigerant circuit 10 shown in FIG. 1.

As described hereinafter, the hot-gas bypass circuit H is formed by connecting nine portions that include a first bypass portion H1 through ninth bypass portion H9, and when refrigerant flows to the hot-gas bypass circuit H, the refrigerant flows in order from the first bypass portion H1 to the ninth bypass portion H9.

The outdoor motor-driven expansion valve 24, the hot-gas bypass valve 27, and the ninth bypass portion H9 of the hot-gas bypass circuit H are fixed to a linking member 29 which is a single member, and an integrated ASSY is thereby formed.

As shown in FIGS. 21, 22, 23, and 1, the outdoor-side liquid tube D extending from the outdoor heat exchanger 23 to the outdoor motor-driven expansion valve 24 merges with the hot-gas bypass circuit H at the branch point D1. The refrigerant merged at the branch point D1 reaches the outdoor motor-driven expansion valve 24 by continuing to flow upward. The portion immediately before the branch point D1 of the outdoor-side liquid tube D extending from the outdoor heat exchanger 23 is retained by a tube loop fixture 29*a*. The tube loop fixture 29*a* is screwed to the linking member 29 via a screw 29*x*. The portion of the ninth bypass portion H9 of the hot-gas bypass circuit H that is near the boundary with the capillary tube 28 is retained by a tube loop fixture 29*c*. The tube loop fixture 29*c* is also screwed to the linking member 29 via a screw 29*z*. The hot-gas bypass valve 27 is retained by a bypass valve fixing mount 29*b*. The bypass valve fixing mount 29*b* is also screwed to the linking member 29 via a screw 29*y*. The portion of the outdoor-side liquid tube D immediately before the branch point D1, the portion of the ninth bypass portion H9 near the boundary with the capillary tube 28, and the hot-gas bypass valve 27 are thus fixed to the linking member 29, and the ASSY is thereby formed by the outdoor motor-driven expansion valve 24, ninth bypass portion H9, and hot-gas bypass valve 27 which are connected via the branch point D1 and the outdoor-side liquid tube D.

Since the hot-gas bypass circuit H is connected to the outdoor-side liquid tube D via the capillary tube 28, it is possible to bring the refrigerant to a pressure that is near the pressure thereof after being reduced by the outdoor motor-driven expansion valve 24 during air-warming operation. It is thereby possible to minimize the degree to which the pressure of the refrigerant flowing through the outdoor-side liquid tube D is increased by the supply of hot gas to the outdoor-side liquid tube D through the hot-gas bypass circuit H.

<1-5> Structure Near the Bottom Plate of the Outdoor Unit 2

Figure 24:
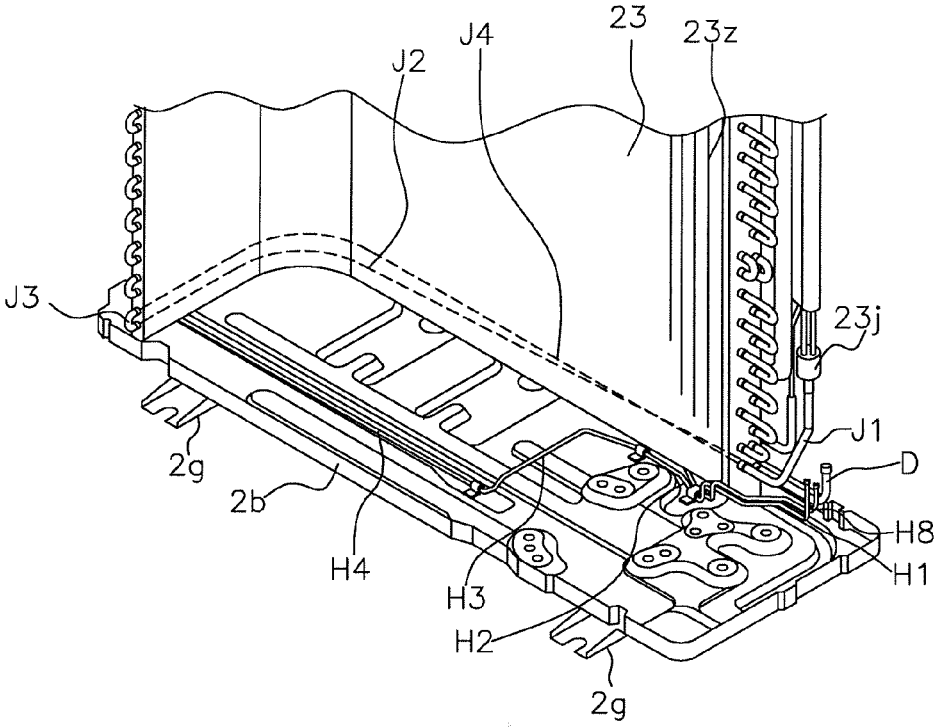
FIG. 24 is a perspective view showing the bottom plate and outdoor heat exchanger of the outdoor unit.
Figure 25:
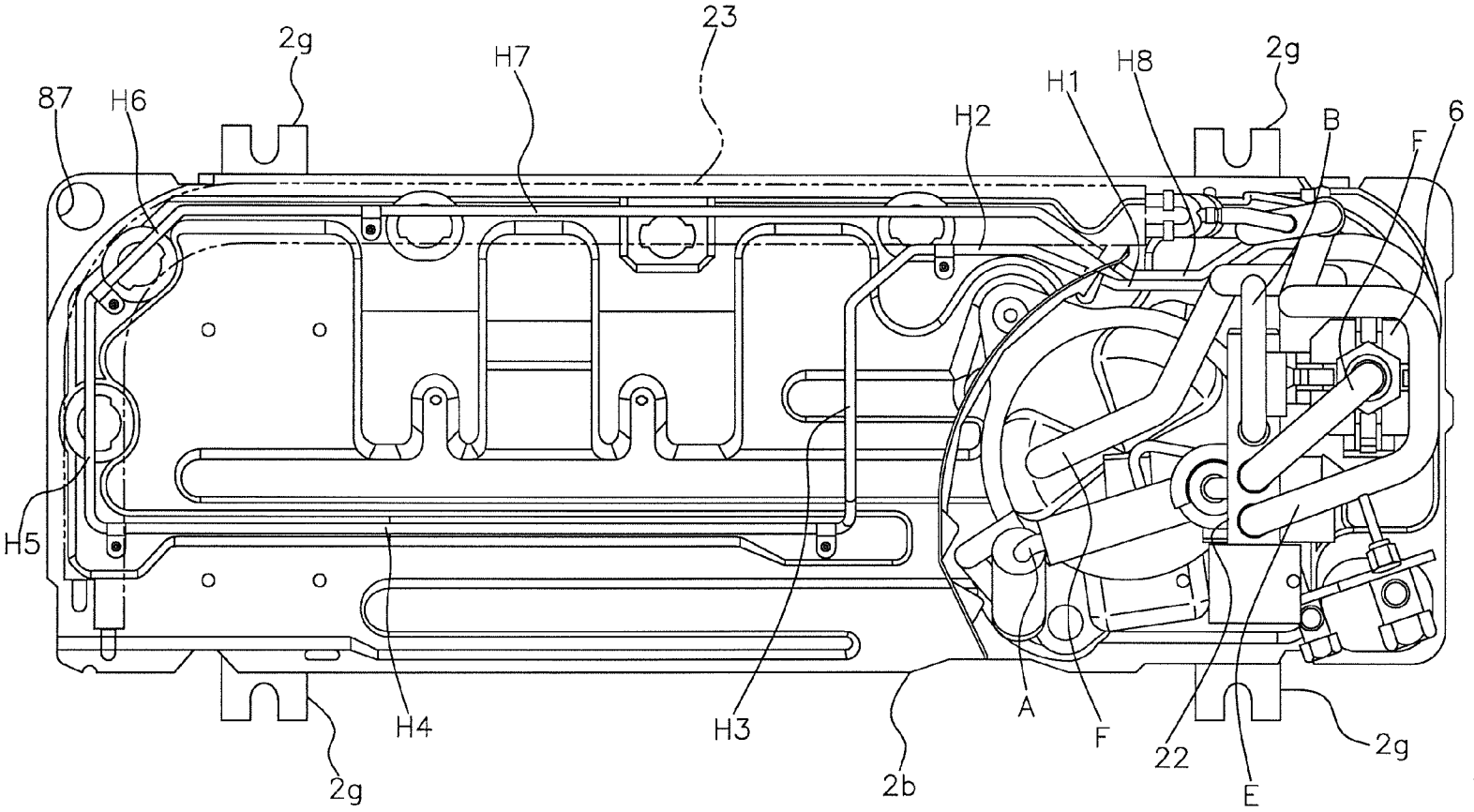
FIG. 25 is a plan view showing a state in which the blower mechanism of the outdoor unit is removed.
Figure 26:
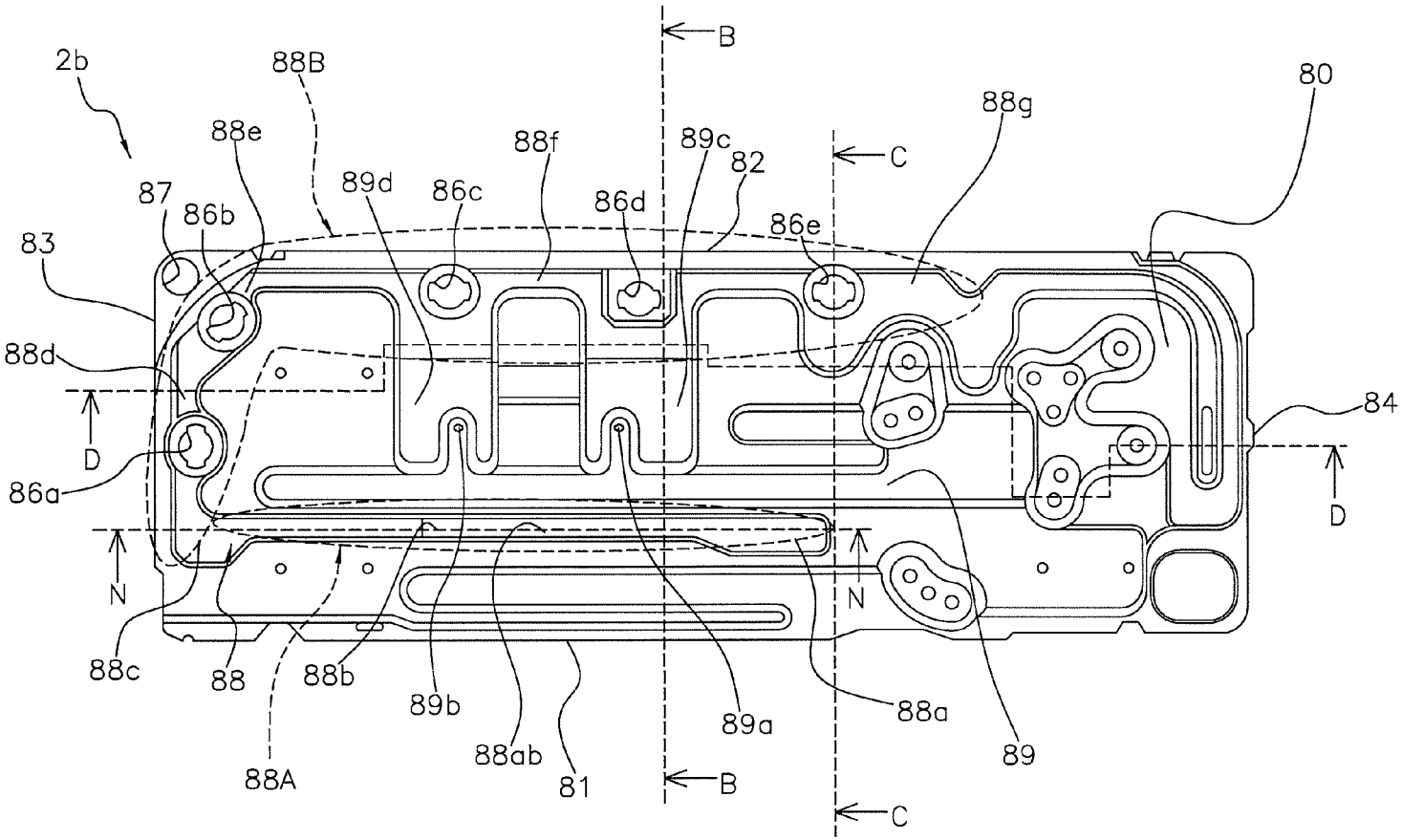
FIG. 26 is a plan view showing the bottom plate of the outdoor unit.

FIG. 24 is a perspective view showing the bottom plate and the outdoor heat exchanger of the outdoor unit 2. FIG. 25 is a plan view showing the outdoor unit 2 in a state in which the blower mechanism is removed. FIG. 26 is a plan view showing the bottom plate of the outdoor unit 2.

As described above, the juncture tube J has a cross-sectional area that corresponds to the cross-sectional area of the first branch tube K1, the second branch tube K2, and the third branch tube K3. The portions corresponding to the first branch tube K1, second branch tube K2, and third branch tube K3 in the outdoor heat exchanger 23 can therefore be endowed with a greater effective surface area of heat exchange than the juncture tube J. Since a larger quantity of refrigerant collects and flows in concentrated fashion in the portion corresponding to the juncture tube J than in the portions corresponding to the first branch tube K1, second branch tube K2, and third branch tube K3, the growth of ice below the outdoor heat exchanger 23 can be more effectively suppressed.

The juncture tube J can make uniform the degree of supercooling of the refrigerant that flows out from the outdoor heat exchanger 23 during air-cooling operation, and can thaw ice that forms in the vicinity of the bottom end of the outdoor heat exchanger 23 during air-warming operation. As shown in FIG. 24, the juncture tube J is formed by the interconnection of a first juncture tube portion J1, a second juncture tube portion J2, a third juncture tube portion J3, and a fourth juncture tube portion J4. The juncture tube J is also arranged so that the refrigerant flowing through the branch tubes K in the outdoor heat exchanger 23 makes a round trip through the lowermost end portion of the outdoor heat exchanger 23 in a state of being merged at the juncture branch point 23*j* so that the flow of refrigerant in the refrigerant circuit 10 is collected into a single flow. The first juncture tube portion J1 extends from the juncture branch point 23*j* to the heat exchange fins 23*z* disposed at the outermost edge of the outdoor heat exchanger 23. The second juncture tube portion J2 extends from the end part of the first juncture tube portion J1 so as to penetrate through a plurality of heat exchange fins 23*z*. The fourth juncture tube portion J4 also extends so as to penetrate through a plurality of heat exchange fins 23*z*, the same as the second juncture tube portion J2. The third juncture tube portion J3 is a U-shaped tube for connecting the second juncture tube portion J2 and the fourth juncture tube portion J4 at the end part of the outdoor heat exchanger 23.

During air-cooling operation, the flow of refrigerant in the refrigerant circuit 10 is such that the plurality of flows divided in the branch tubes K are collected into one by the juncture tube J. Therefore, even when the degree of supercooling of the refrigerant in the portion immediately before the juncture branch point 23*j* among the refrigerant flowing through the branch tubes K is different from each tube that constitutes the branch tubes K, since the refrigerant flow can be merged into one in the juncture tube J, the degree of supercooling of the outlet of the outdoor heat exchanger 23 can be adjusted. In a case in which a defrost operation is performed during air-warming operation, the hot-gas bypass valve 27 is opened, and the high-temperature refrigerant discharged from the compressor 21 can be fed to the juncture tube J provided to the bottom end of the outdoor heat exchanger 23 before being fed to the other portions of the outdoor heat exchanger 23. Ice that forms near the area below the outdoor heat exchanger 23 can therefore be effectively thawed.

As shown in FIGS. 24 and 25, the hot-gas bypass circuit H has a first bypass portion H1 through eighth bypass portion H8. The hot-gas bypass circuit H branches from the discharge tube A at the branch point A1 and extends to the hot-gas bypass valve 27, and a portion that extends further from the hot-gas bypass valve 27 is the first bypass portion H1. The second bypass portion H2 extends from the end of the first bypass portion H1 to the blower chamber side in the vicinity of the back surface. The third bypass portion H3 extends toward the front surface from the end of the second bypass portion H2. The fourth bypass portion H4 extends from the end of the third bypass portion H3 toward the left side, which is the side opposite that of the mechanical chamber. The fifth bypass portion H5 extends from the end of the fourth bypass portion H4 toward the back side to a portion in which a gap is maintained with the back panel 2*e* of the outdoor unit casing. The sixth bypass portion H6 extends from the end of the fifth bypass portion H5 toward the back surface and to the right, which is the side towards the mechanical chamber. The seventh bypass portion H7 extends to the right from the end of the sixth bypass portion H6 into the blower chamber, on the mechanical chamber side. The eighth bypass portion H8 extends into the mechanical chamber from the end of the seventh bypass portion H7. The ninth bypass portion H9 extends from the end of the eighth bypass portion H8 to the capillary tube 28.

As described above, the hot-gas bypass circuit H directs refrigerant in order from the first bypass portion H1 to the ninth bypass portion H9 in a state in which the hot-gas bypass valve 27 is open. The refrigerant branched at the branch point A1 of the discharge tube A that extends from the compressor 21 therefore flows through the first bypass portion H1 side before the refrigerant that flows through the ninth bypass portion H9. Therefore, when the refrigerant flowing through the hot-gas bypass circuit H is viewed as a whole, the refrigerant that has flowed through the fourth bypass portion H4 flows to the fifth through the eighth bypass portion H8, and the temperature of the refrigerant flowing through the fourth bypass portion H4 is prone to be higher than the temperature of the refrigerant flowing through the fifth through the eighth bypass portion H8.

(Bottom Plate 2*b* of the Outdoor Unit 2)

Figure 27:
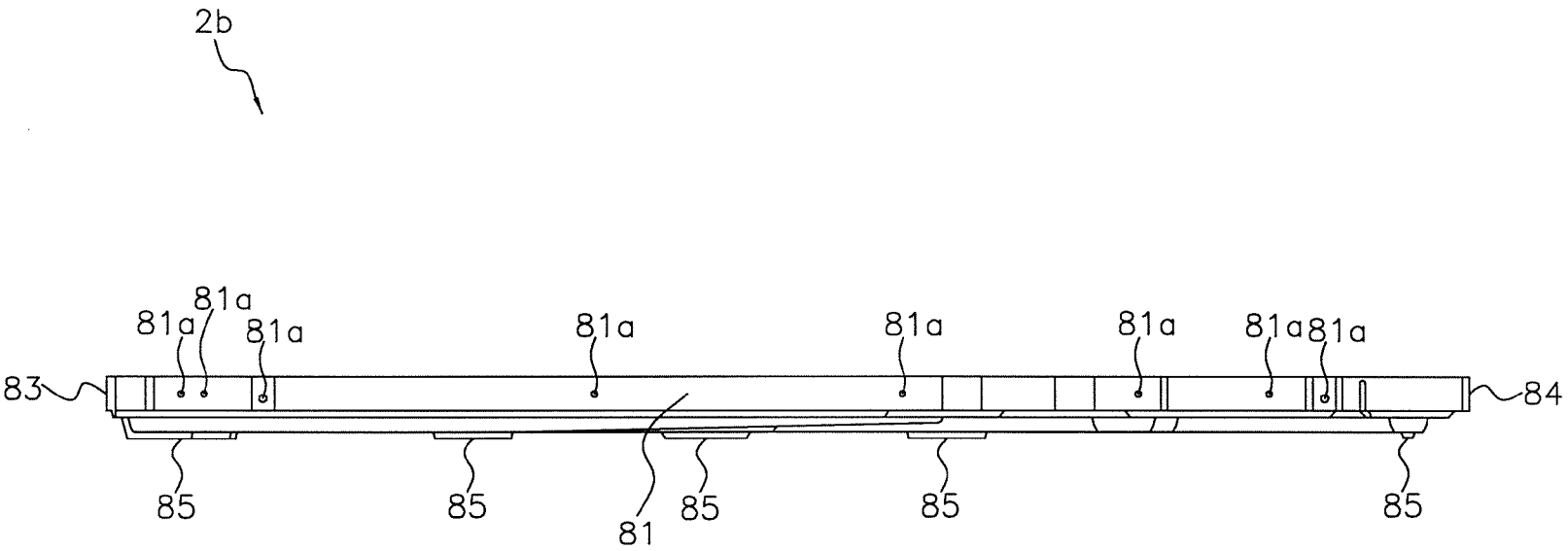
FIG. 27 is a front view showing the bottom plate of the outdoor unit.
Figure 28:
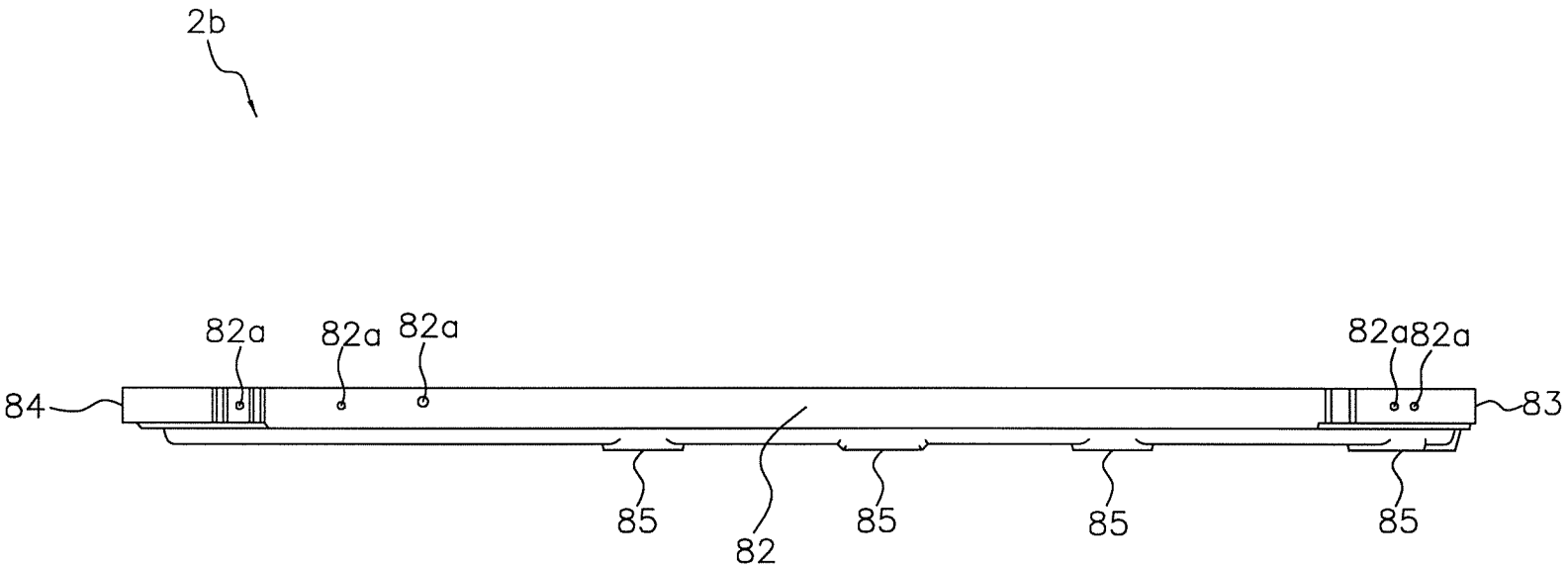
FIG. 28 is a back view showing the bottom plate of the outdoor unit.
Figure 29:
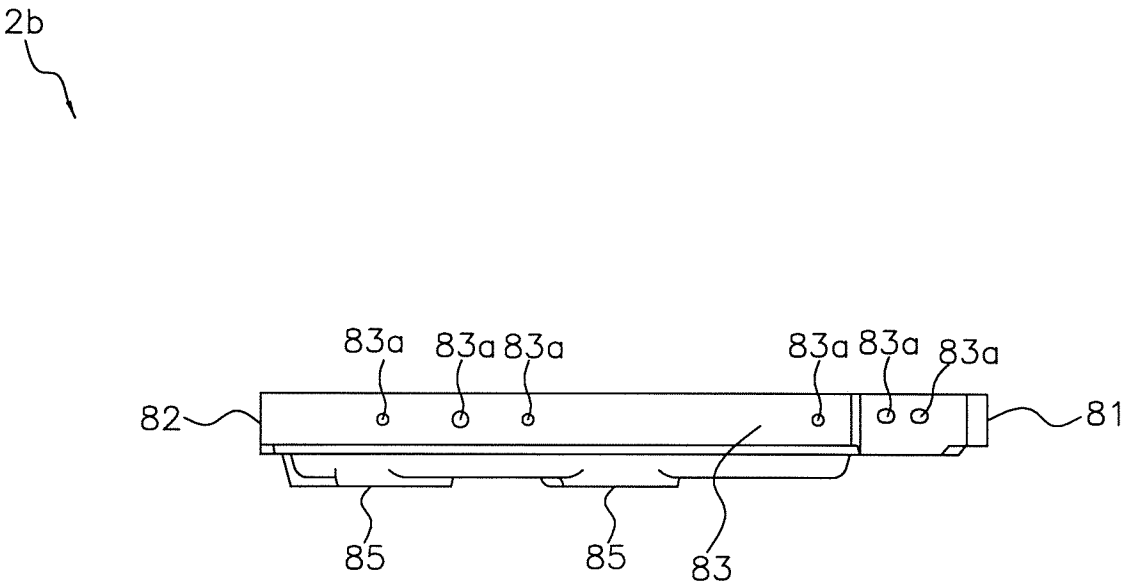
FIG. 29 is a left-side view showing the bottom plate of the outdoor unit.
Figure 30:
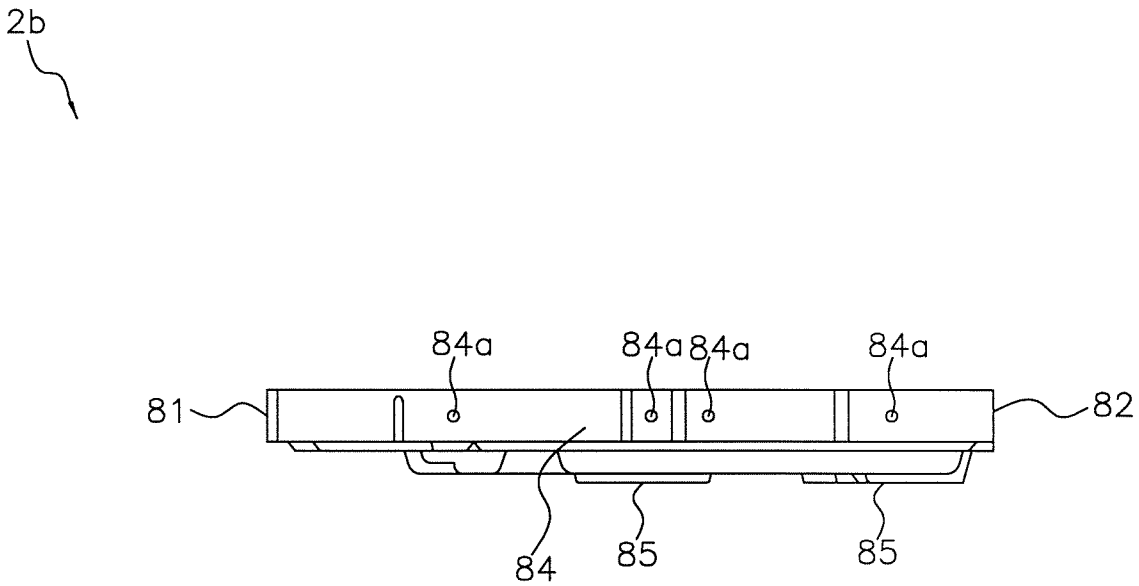
FIG. 30 is a right-side view showing the bottom plate of the outdoor unit.

FIG. 26 is a plan view showing the bottom plate 2*b* of the outdoor unit 2. FIG. 27 is a front view showing the bottom plate 2*b* of the outdoor unit. FIG. 28 is a back view showing the bottom plate 2*b* of the outdoor unit 2. FIG. 29 is a left-side view showing the bottom plate 2*b* of the outdoor unit 2. FIG. 30 is a right-side view showing the bottom plate 2*b* of the outdoor unit.

The bottom plate 2*b* has a bottom-plate front surface part 81, a bottom-plate back surface part 82, a bottom-plate left surface part 83, and a bottom-plate right surface part 84 which extend from a bottom plate main body 80 that extends substantially horizontally. The bottom-plate front surface part 81 extends slightly upward vertically from the end part of the front side of the bottom plate main body 80, and has a plurality of screw holes 81*a* which penetrate through in the thickness direction for screwing together with the bottom end of the front panel 2*c*. The bottom-plate back surface part 82 extends slightly upward vertically from the end part of the back side of the bottom plate main body 80, and has a plurality of screw holes 82*a* which penetrate through in the thickness direction for screwing together with the bottom end of the back panel 2*e*. The bottom-plate left surface part 83 extends slightly upward vertically from the end part on the left side of the bottom plate main body 80, and has a plurality of screw holes 83*a* which penetrate through in the thickness direction for screwing together with the bottom end of the left-side panel 2*d*. The bottom-plate right surface part 84 extends slightly upward vertically from the end part on the right side of the bottom plate main body 80, and has a plurality of screw holes 84*a* which penetrate through in the thickness direction for screwing together with the bottom end of the right-side panel 2*f*.

The bottom plate main body 80 has bottom portions 85 which are formed as depressions in the vertical direction so as to be positioned at the lowest end in the vertical direction.

(Contours and Opening Shape of the Bottom Plate 2*b*)

Figure 31:
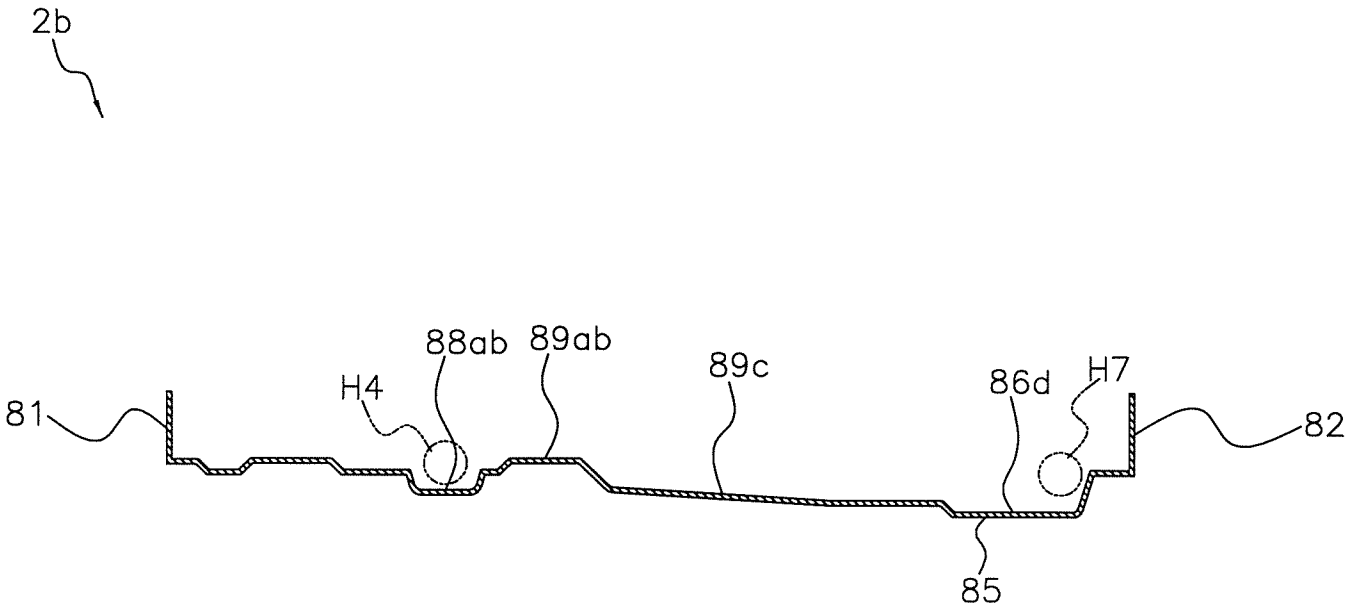
FIG. 31 is a sectional view along line B-B of FIG. 26.
Figure 32:
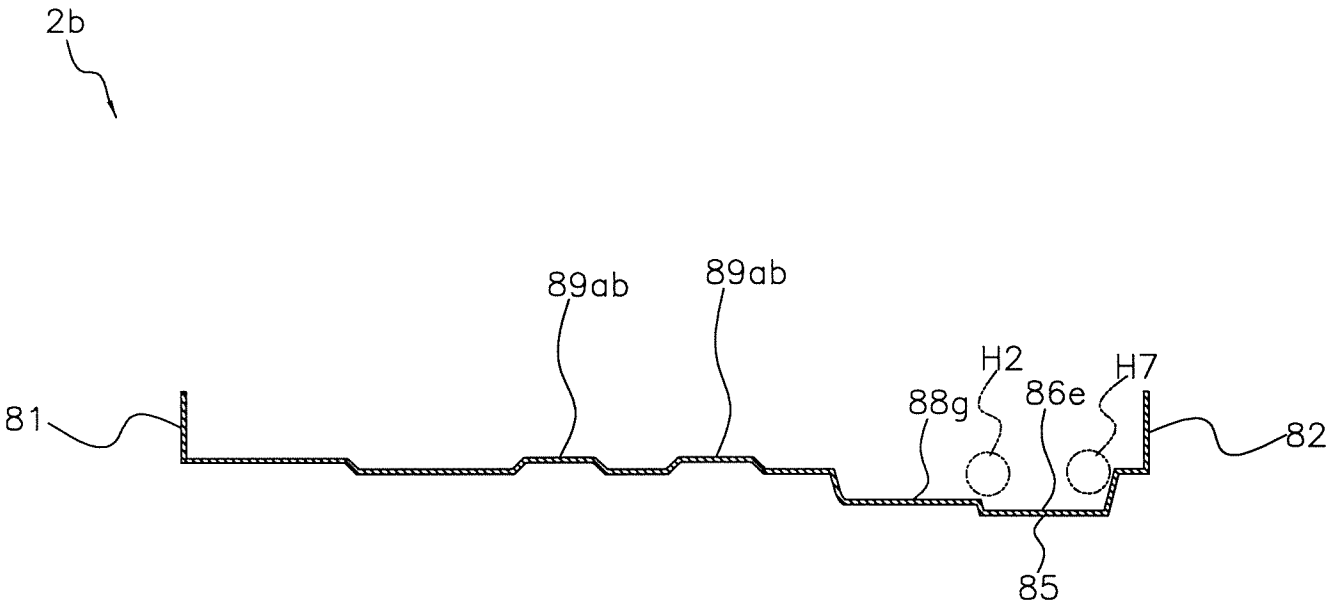
FIG. 32 is a sectional view along line C-C of FIG. 26.
Figure 33:
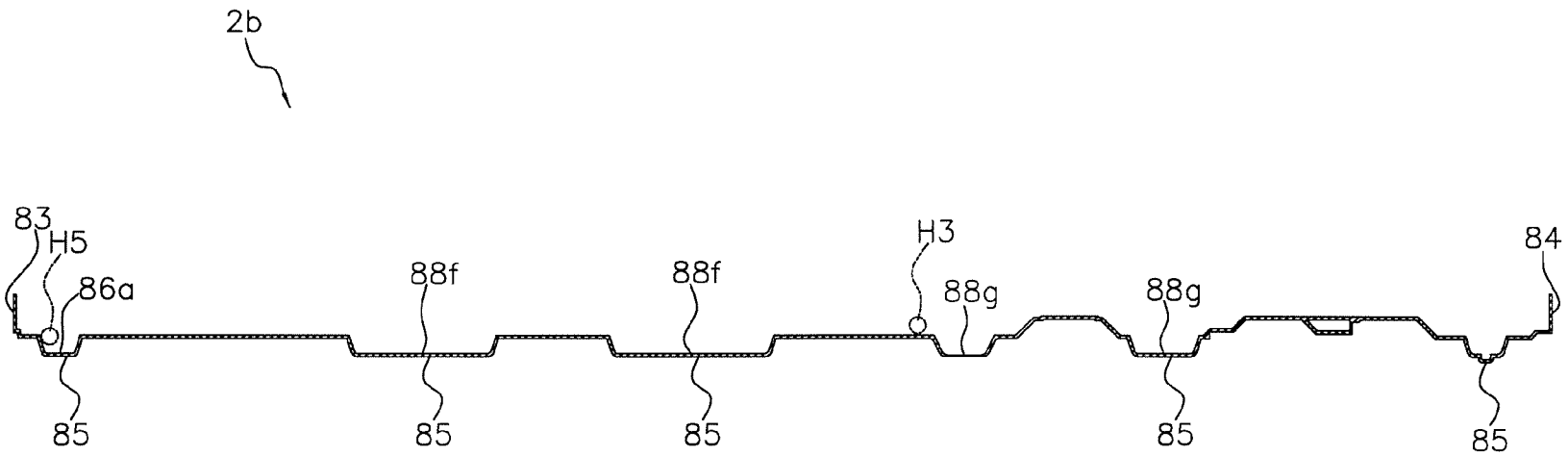
FIG. 33 is a sectional view along line D-D of FIG. 26.
Figure 34:
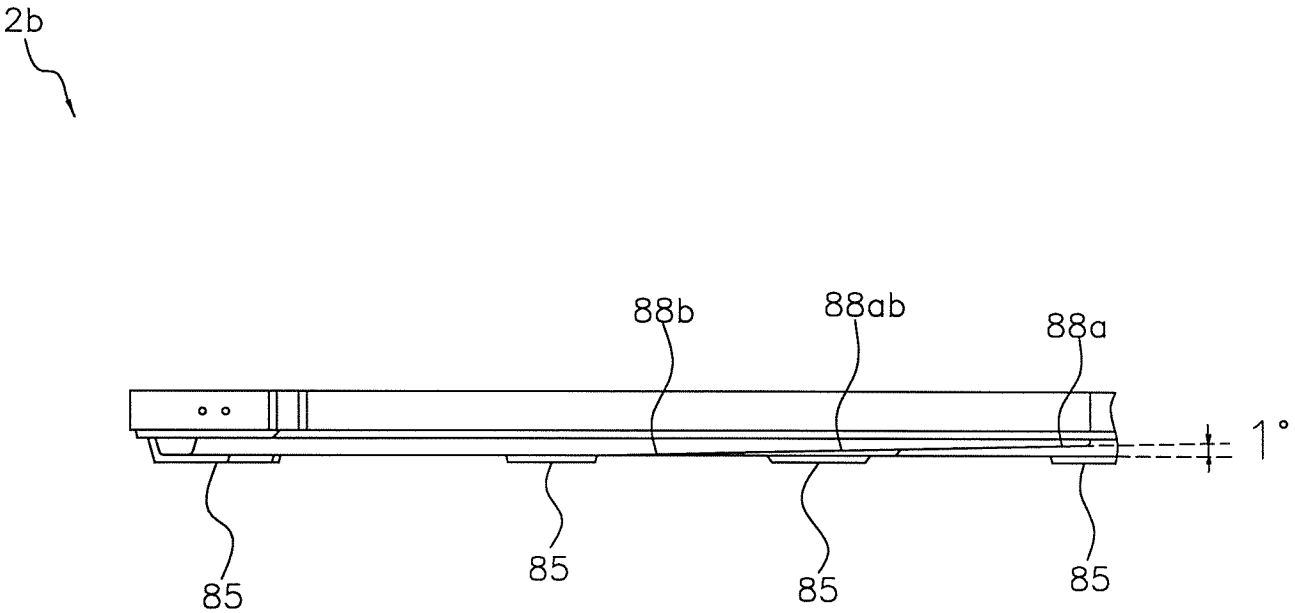
FIG. 34 is a view showing the configuration in the vicinity of the section along line N-N of FIG. 26.

FIG. 31 is a sectional view along line B-B of FIG. 26. FIG. 32 is a sectional view along line C-C of FIG. 26. FIG. 33 is a sectional view along line D-D of FIG. 26. FIG. 34 is a view showing the configuration in the vicinity of the section along line N-N of FIG. 26.

The bottom plate main body 80 has a drainage gutter part 88 formed so as to be slightly depressed in the vertical direction relative to the periphery thereof in order to drain the drain water, rainwater, and the like that falls from the outdoor fans 26 or the outdoor heat exchanger 23. The drainage gutter part 88 has primarily a fan-blade underlying part 88A positioned below the outdoor fans 26, and an outdoor heat exchanger underlying part 88B positioned below the outdoor heat exchanger 23. The depth of the deepest portion of the gutter formed in the bottom plate main body 80 is 10 mm.

The fan-blade underlying part 88A extends from the vicinity of the bottom end where the partition panel 2*h* is positioned toward the left side, which is the side opposite that of the mechanical chamber, through the inside of the blower chamber to the vicinity of the bottom-plate left surface part 83. The fan-blade underlying part 88A is provided in a position which is the downward projection of the position through which the portions of the blades farthest from the rotational axes of the outdoor fans 26 pass. The distance from the rotational axis of each of the outdoor fans 26 to the distal ends of the blades tends to increase in order to increase the airflow. Therefore, the portion of the blades farthest from the rotational axis of the outdoor fan 26 is likely to pass over near the top surface of the bottom plate 2*b* in the state in which the outdoor fan 26 is installed. It is therefore preferred that ice not be allowed to grow on the bottom plate main body 80 in the area below the portion through which the blades pass. The fan-blade underlying part 88A has a high part 88*a* which is the vicinity of the partition panel 2*h*, a low part 88*b* positioned lower than the high part 88*a*, and an inclined part 88*ab* which is a gutter for connecting the high part 88*a* and the low part 88*b*. As shown in the view of FIG. 34 showing the configuration in the vicinity of the section along line N-N, the inclined part 88*ab* is inclined one degree from the horizontal direction so as to rise from the left side to the mechanical chamber side. Water that fall on the high part 88*a* below the outdoor fans 26 thereby flows down to the low part 88*b*. The blades can thereby be prevented from being damaged by ice even when the outdoor fans 26 are shaped so as to extend nearer to the bottom plate 2*b*.

As shown in FIG. 33 in the sectional view along line D-D, the outdoor heat exchanger underlying part 88B is provided in a position which is the downward projection of the outdoor heat exchanger 23, and the outdoor heat exchanger underlying part 88B has a front left corner gutter 88*c*, a left-side gutter 88*d*, a back left corner gutter 88*e*, a back-side gutter 88*f*, and a back mechanical-chamber-side gutter 88*g*. The front left corner gutter 88*c* is a gutter which is continuously connected at the same height as the low part 88*b* of the fan-blade underlying part 88A, and the front left corner gutter 88*c* extends toward the back side from the vicinity of the end part on the left side. The left-side gutter 88*d* further extends toward the back side at the same height as the back left corner gutter 88*e*. The back left corner gutter 88*e* extends from the end part on the back surface side of the left-side gutter 88*d* toward the back side and to the right, at the same height as the left-side gutter 88*d*. The back-side gutter 88*f* further extends toward the right side at the back side in the vicinity of the end part of the back left corner gutter 88*e*, at the same height as the back left corner gutter 88*e*. The back mechanical-chamber-side gutter 88*g* further extends to the right from the right end part of the back-side gutter 88*f* so as to reach the mechanical chamber side, at the same height as the back-side gutter 88*f*.

In the left-side gutter 88*d*, a drainage port 86*a* which penetrates through in the vertical direction, which is the thickness direction of the bottom plate main body 80, is formed in a low portion of the gutter to enable drainage of drain water and other water. In the back left corner gutter 88*e*, a drainage port 86*b* which penetrates through in the vertical direction, which is the thickness direction of the bottom plate main body 80, is formed in a low portion of the gutter. In the back-side gutter 88*f*, drainage ports 86*c*, 86*d*, 86*e* which penetrate through in the vertical direction, which is the thickness direction of the bottom plate main body 80, are formed in a low portion of the gutter.

An outside drainage port 87 which penetrates through in the vertical direction, which is the thickness direction of the bottom plate main body 80, is formed in the bottom plate main body 80 at a position toward the back side from the back left corner gutter 88*e* and to the left of the back left corner gutter 88*e*. A gap is formed between the outdoor unit casing and the outdoor heat exchanger 23 on the top side of the bottom plate main body 80 on the periphery of the outside drainage port 87, and fallen snow or rainwater sometimes enters the gap. In other words, since a plurality of openings used for air flows are provided to the left-side panel 2*d*, and a plurality of openings for air flows are provided in the back panel 2*e* as well, as shown in FIG. 5, snow or water sometimes enters through these openings and accumulates on top of the bottom plate main body 80 on the periphery of the outside drainage port 87. However, water or snow can be drained via the outside drainage port 87 so that fallen snow or water does not accumulate at the position of the bottom plate main body 80 toward the back side from the back left corner gutter 88*e* and to the left of the back left corner gutter 88*e*.

A fan stage 89 formed so as to protrude upward in relation to the periphery thereof is provided to support the outdoor fans 26, as shown in FIG. 32 in the sectional view along line C-C, in the portion of the bottom plate main body 80 on the blower chamber side between the fan-blade underlying part 88A and the outdoor heat exchanger underlying part 88B. The fan stage 89 has a first fan stage portion 89*a* for supporting the outdoor fans 26 on the mechanical chamber side, and a second fan stage portion 89*b* for supporting the outdoor fans 26 on the left side with respect to the first fan stage portion 89*a*. As shown in FIG. 31 in the sectional view along line B-B, a first fan back-surface inclined part 89*c* which is inclined downward toward the back-surface side is provided on the back-surface side of the first fan stage portion 89*a*. A second fan back-surface inclined part 89*d* which is inclined downward toward the back-surface side is provided on the back-surface side of the second fan stage portion 89*b*. The inclined parts which include the first fan back-surface inclined part 89*c* and the second fan back-surface inclined part 89*d* make it possible for the drain water and the like from the outdoor fans 26 that falls on the back-surface side without falling on the side of the fan-blade underlying part 88A to be more effectively directed to the back-surface side and drained.

As described above, the drainage ports 86*a* through 86*e* and the outside drainage port 87, which are openings penetrating through in the vertical direction, are formed in the bottom plate main body 80, but besides the screw holes and the like, no openings which penetrate through in the vertical direction are formed in the area on the side where the outdoor fans 26 are provided, which is the fan-blade underlying part 88A side with respect to the outdoor heat exchanger underlying part 88B in planar view. Since there is therefore no communication with the portion positioned on the side of the outdoor fans 26 with respect to the outdoor heat exchanger 23 in planar view, an air flow (shortcut flow) that does not pass through the outdoor heat exchanger 23 can be prevented from forming in the state in which the outdoor fans 26 are activated. In a case in which water adheres to the bottom plate 2*b* below the outdoor fans 26, the absence of a nearby opening makes freezing prone to occur, but a priority supply of heat is provided to the bottom plate 2*b* below the outdoor fans 26 by the warm refrigerant that is fed through the hot-gas bypass circuit H. It is thereby possible to efficiently suppress the growth of ice below the outdoor fans 26 while enhancing the efficiency with which the air flow created by the outdoor fans 26 passes through the outdoor heat exchanger 23.

In the bottom plate main body 80, besides the screw holes and the like, since no openings which penetrate through in the vertical direction are formed in the area on the side where the outdoor fans 26 are provided, which is the fan-blade underlying part 88A side with respect to the outdoor heat exchanger underlying part 88B in planar view, as described above, there is a risk of water freezing instead of being drained. However, since the side of the hot-gas bypass circuit H closer to the branch point A1 flows under the outdoor fans 26, the growth of ice under the outdoor fans 26 can be suppressed even in a case in which no opening is provided below the outdoor fans 26.

(Shape of the Hot Gas Bypass Circuit H)

Figure 35:
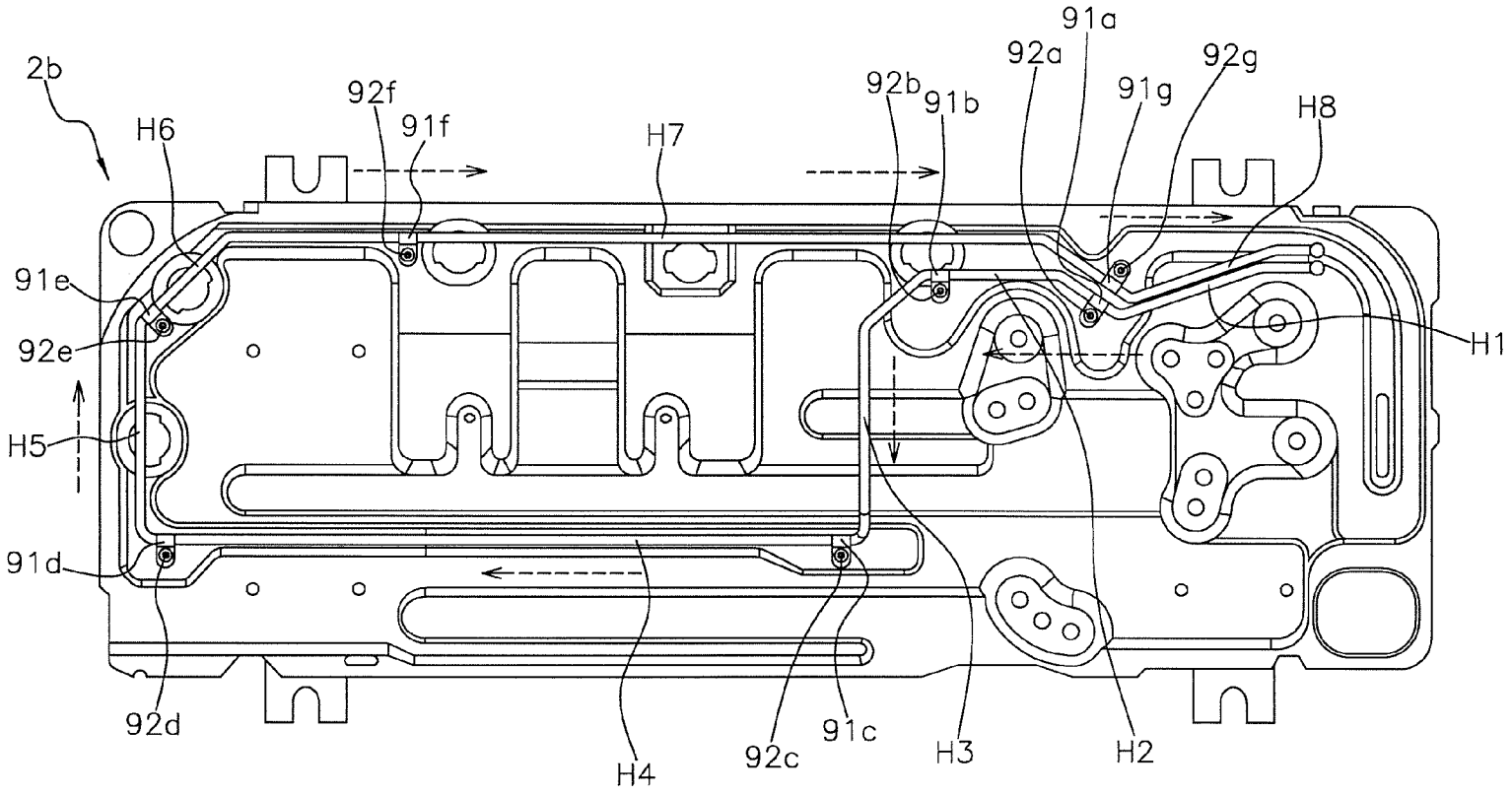
FIG. 35 is a plan view showing the positional relationship between the hot gas bypass circuit and the bottom plate of the outdoor unit.
Figure 36:
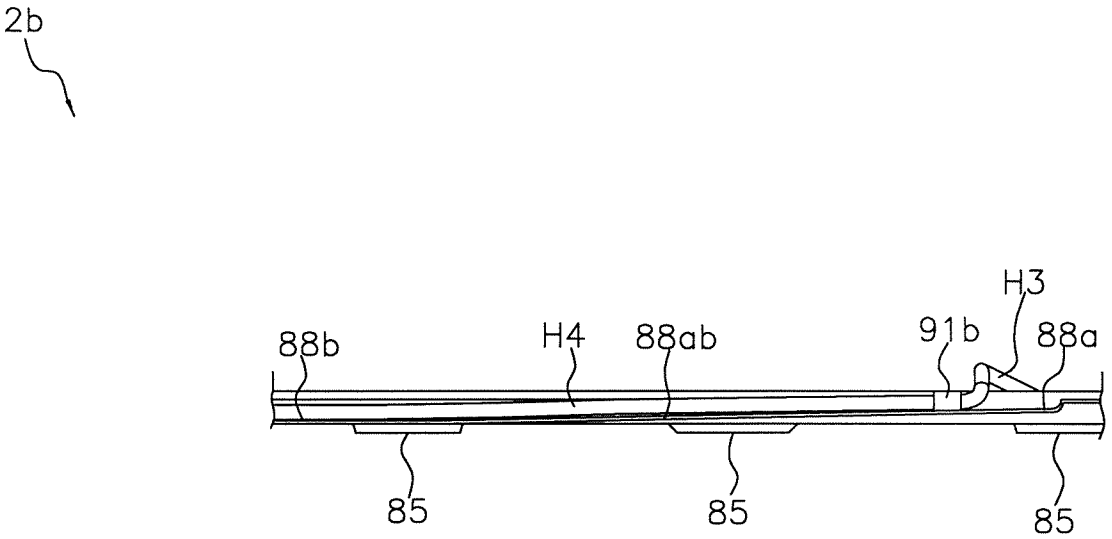
FIG. 36 is a front view showing the positional relationship between the hot gas bypass circuit and the bottom plate in the vicinity of the area below the fan blades.

FIG. 35 is a plan view showing the positional relationship between the hot gas bypass circuit H and the bottom plate of the outdoor unit 2. FIG. 36 is a front view in the inclined portion under the outdoor fans.

As described above, the first bypass portion H1 through eighth bypass portion H8 are connected on the bottom plate 2*b* to form the hot-gas bypass circuit H. A loop fixture 91*a* is provided around the boundary portion between the first bypass portion H1 and the second bypass portion H2. The loop fixture 91*a* is screwed to the bottom plate main body 80 by a screw 92*a*. A loop fixture 91*b* is provided around the portion near the boundary of the second bypass portion H2 and the third bypass portion H3, and the loop fixture 91*b* is screwed to the bottom plate main body 80 by a screw 92*b*.

A loop fixture 91*c* is provided around the portion near the boundary of the third bypass portion H3 and the fourth bypass portion H4, and the loop fixture 91*c* is screwed to the bottom plate main body 80 by a screw 92*c*. A loop fixture 91*d* is provided around the portion near the boundary of the fourth bypass portion H4 and the fifth bypass portion H5, and the loop fixture 91*d* is screwed to the bottom plate main body 80 by a screw 92*d*. The lowest end parts of all portions of the fourth bypass portion H4 are thereby positioned at a height between the lowest end part of the gutter-shaped portion of the fan-blade underlying part 88A and the high portion of the bottom plate main body 80 on the periphery of the gutter-shaped portion of the fan-blade underlying part 88A as viewed from the front. In other words, the fourth bypass portion H4 is disposed so as to be hidden in the space of the gutter-shaped portion of the fan-blade underlying part 88A. It is thereby possible to more effectively suppress the formation and growth of ice in the gutter portion of the fan-blade underlying part 88A.

A loop fixture 91*e* is provided around the portion near the boundary of the fifth bypass portion H5 and the sixth bypass portion H6, and the loop fixture 91*e* is screwed to the bottom plate main body 80 by a screw 92*e*. A loop fixture 91*f* is provided around the portion of the seventh bypass portion H7 to the left of the center thereof, and the loop fixture 91*f* is screwed to the bottom plate main body 80 by a screw 92*f*. A loop fixture 91*g* is provided around the portion near the boundary of the seventh bypass portion H7 and the eighth bypass portion H8, and the loop fixture 91*g* is screwed to the bottom plate main body 80 by a screw 92*g*. The lowest end parts of all portions of the fifth bypass portion H5, sixth bypass portion H6, seventh bypass portion H7, and eighth bypass portion H8 are thereby positioned at a height between the lowest end part of the gutter-shaped portion of the outdoor heat exchanger underlying part 88B and the high portion of the bottom plate main body 80 on the periphery of the gutter-shaped portion of the outdoor heat exchanger underlying part 88B as viewed from the front. In other words, the fifth bypass portion H5, sixth bypass portion H6, seventh bypass portion H7, and eighth bypass portion H8 are all disposed so as to be hidden in the space of the gutter-shaped portion of the outdoor heat exchanger underlying part 88B. It is thereby possible to more effectively suppress the formation and growth of ice in the gutter portion of the outdoor heat exchanger underlying part 88B. A gap of about 2.6 mm is provided between the bottom end part of the outdoor heat exchanger 23 and the fifth bypass portion H5, sixth bypass portion H6, seventh bypass portion H7, and eighth bypass portion H8 of the hot-gas bypass circuit H.

The fifth bypass portion H5 of the hot-gas bypass circuit H passes nearly directly over the drainage port 86*a*. The drainage port 86*a* can therefore be prevented from being blocked by ice formation. The sixth bypass portion H6 of the hot-gas bypass circuit H passes nearly directly over the drainage port 86*b* in the same manner. The drainage port 86*b* can therefore be prevented from being blocked by ice formation. The seventh bypass portion H7 of the hot-gas bypass circuit H also passes nearly directly over the drainage ports 86*c*, 86*d*, 86*e*. The drainage ports 86*c*, 86*d*, 86*e* can therefore be prevented from being blocked by ice formation.

As shown in FIG. 36, in the bottom plate 2*b*, the fourth bypass portion H4 disposed above the inclined part 88*ab* of the fan-blade underlying part 88A is inclined parallel to the inclination of the inclined part 88*ab* of the fan-blade underlying part 88A. The bottom end part of the fourth bypass portion H4 is also disposed so as to be hidden in the gutter-shaped portion of the fan-blade underlying part 88A. Water can thereby be more effectively drained so that ice does not grow directly below the blade portion of the outdoor fans 26, and also so that ice does not grow in the gutter portion of the fan-blade underlying part 88A. When a defrost operation is performed during air-warming operation, high-temperature refrigerant that has not significantly cooled after being discharged from the compressor 21 before flowing to the outdoor heat exchanger underlying part 88B is fed to the fourth bypass portion H4 at a higher priority than to the outdoor heat exchanger underlying part 88B. Therefore, even when ice forms directly below the blade portion of the outdoor fans 26, the ice can be more effectively thawed by operation with the hot-gas bypass valve 27 open. Furthermore, the water formed by such thawing is effectively drained by the inclined part 88*ab*, and can therefore also be effectively prevented from refreezing under the blade portion of the outdoor fans 26. It is thereby possible to prevent a state in which the blade portion of the outdoor fans 26 is damaged by the formation of ice on the surface of the bottom plate main body 80 and rendered unable to rotate.

The portions of the hot-gas bypass circuit H that are fixed by screws are held in the fixed state about 1 mm upward apart from the top surface of the bottom plate 2*b*.

The term "defrost operation" used above refers to creating a state in which the hot-gas bypass valve 27 is open while the connection state of the four-way switching valve 22 is maintained in the air-warming operation state in which the four-way switching valve 22 connects the discharge side of the compressor 21 with the indoor heat exchanger 41, rather than the connection state of the four-way switching valve 22 being temporarily switched from the air-warming operation connection state to the air-cooling operation connection state.

Features of the Air Conditioning Apparatus 1 of the Present Embodiment

In the air conditioning apparatus 1 of the present embodiment, depending on the environment in which the outdoor unit 2 is installed, the top of the bottom plate 2*b* is sometimes wetted by rainwater or drain water that forms in the outdoor heat exchanger 23.

However, in the air conditioning apparatus 1 of the present embodiment, the hot-gas bypass circuit H is provided so as to pass through the vicinity of the portion of the bottom plate 2*b* of the outdoor unit housing below the outdoor fans 26 and below the outdoor heat exchanger 23. The vicinity of the portion through which the hot-gas bypass circuit H passes can therefore be warmed by high-temperature refrigerant that is branched and fed from the discharge tube A of the compressor 21, without the use of a separate heat source such as a heater. The growth of ice on the bottom plate 2*b* below the outdoor fans 26 and below the outdoor heat exchanger 23 can thereby be suppressed even when the top of the bottom plate 2*b* becomes wet. It is thereby possible to prevent a condition in which operation of the outdoor fans 26 is hindered by ice, or the surface of the outdoor heat exchanger 23 is covered with ice and heat exchange efficiency is reduced.

The hot-gas bypass circuit H also is disposed so as to pass below the outdoor fans 26 before passing below the outdoor heat exchanger 23 after branching at the branch point A1 of the discharge tube A. A higher priority can therefore be placed on preventing the growth of ice below the outdoor fans 26.

Other Embodiments

Embodiments of the present invention are described above with reference to the drawings, but the specific configuration is not limited to these embodiments, and can be changed within a range that does not deviate from the scope of the invention.

(A)

An example is described in the embodiment above in which the defrost operation is an operation for placing the hot-gas bypass valve 27 in an open state while maintaining the connection state of the four-way switching valve 22 in the air-warming operation state in which the four-way switching valve 22 is in a connection state whereby the indoor heat exchanger 41 and the discharge side of the compressor 21 are connected.

However, the present invention is not limited to this configuration.

For example, the defrost operation may be an operation in which the connection state of the four-way switching valve 22 is temporarily switched from the air-warming operation connection state to the air-cooling operation connection state. In this case, a refrigerant circuit provided with a switching mechanism is utilized so that the refrigerant discharged from the compressor 21 passes through the fan-blade underlying part 88A before passing through the outdoor heat exchanger underlying part 88B at the time of the temporary switch from the air-warming operation connections state to the air-cooling operation connection state.

(B)

In the above embodiment, an example is described of a refrigerant circuit 10 in which the hot-gas bypass circuit H bypasses the branch point A1 of the discharge tube A and the branch point D1 of the outdoor-side liquid tube D.

However, the present invention is not limited to this configuration.

Figure 37:
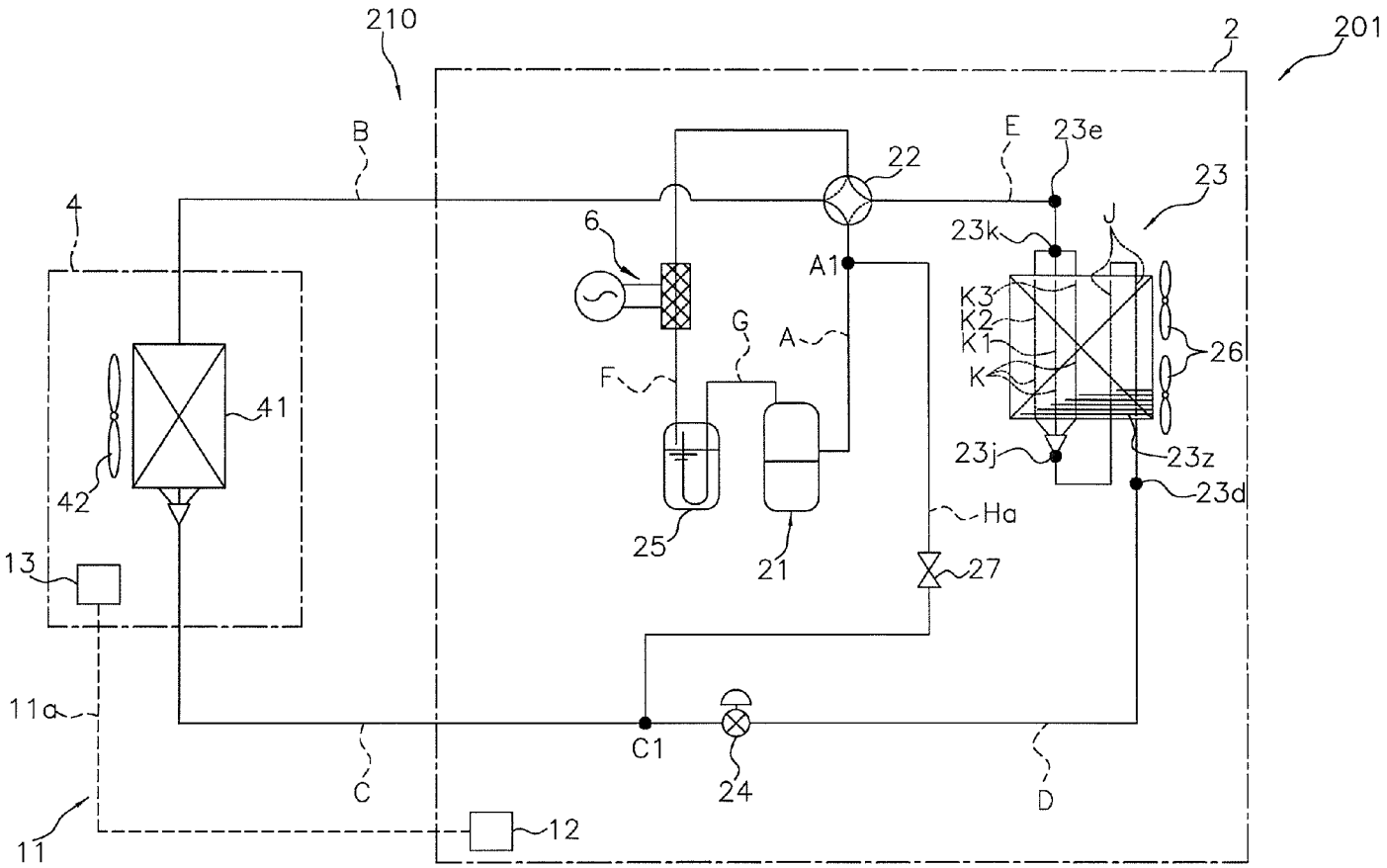
FIG. 37 is a refrigerant circuit diagram showing another embodiment (B).

As shown in FIG. 37, an air conditioning apparatus 201 may be provided with a refrigerant circuit 210 which has a hot-gas bypass circuit Ha provided so as to bypass the branch point A1 of the discharge tube A and a branch point C1 of the indoor-side liquid tube C, for example. In this case as well, the hot-gas bypass circuit Ha may be provided so as to pass under the outdoor fans 26 before passing under the outdoor heat exchanger 23.

(C)

In the above embodiment, a case is described in which the hot-gas bypass circuit H passing above the drainage ports 86*a* through 86*e* that are provided to the bottom plate main body 80 is provided so as to extend in the horizontal direction.

However, the present invention is not limited to this configuration.

Figure 38:
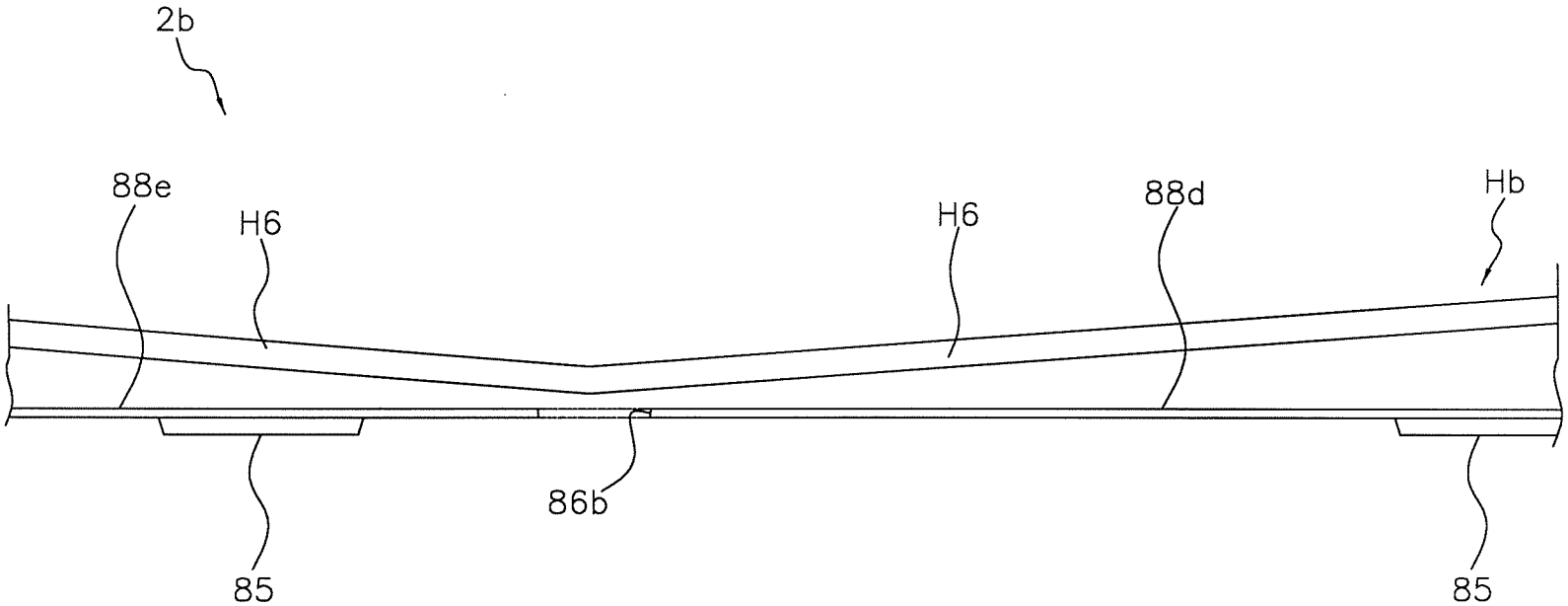
FIG. 38 is a refrigerant circuit diagram showing another embodiment (C).

As shown in FIG. 38, the sixth bypass portion H6 of a hot-gas bypass circuit Hb that passes through above the drainage port 86*b* may be inclined so that the lowest end thereof is positioned over the drainage port 86*b*.

The configuration is also not limited to a combination of the drainage port 86*b* and the sixth bypass portion H6, and the hot-gas bypass circuit Hb may have a portion that is inclined so that the portion passing above the drainage ports 86*a* through 86*e* is the bottom end.

Water that flows along the bottom end of the tube of the hot-gas bypass circuit Hb can thereby be directed near the area above the drainage ports 86*a* through 86*e* by the inclination, and the drainage effects can be enhanced.

INDUSTRIAL APPLICABILITY

Through the use of the present invention, growth of ice on the bottom plate of the outdoor unit can be suppressed without the use of a configuration that is distinguished from the refrigeration cycle, such as a heater. The present invention is therefore useful particularly in an electromagnetic induction heating unit and air conditioning apparatus in which electromagnetic induction is used to heat a refrigerant.

What is claimed is:

1. An air conditioning apparatus comprising:

a compression mechanism;

a heat source-side heat exchanger having a first vertical side facing a first lateral direction, a second vertical side spaced from the first vertical side and facing a second lateral direction, and a bottom surface extending between bottom ends of the first and second vertical sides;

an expansion mechanism;

a usage-side heat exchanger;

a blower arranged and configured to feed an air flow to said heat source-side heat exchanger, the blower being disposed adjacent to the first vertical side of the heat exchanger and spaced from the first vertical side of the heat exchanger in the first lateral direction;

housings including a bottom plate having an upper surface, said housings being arranged and configured to accommodate said heat source-side heat exchanger and said blower in a space above said bottom plate; and a bypass circuit disposed so as to pass below said blower and below said heat source-side heat exchanger, said bypass circuit extending along said bottom surface of said heat source-side heat exchanger and extending along said upper surface of said bottom plate such that said bypass circuit is below said heat source-side heat exchanger, said bypass circuit including a first section and a second section, the first section passing below said blower from a third refrigerant tube, and the second section passing below said heat source-side heat exchanger from the first section and extending to the at least one of a first refrigerant tube and a second refrigerant tube, the first section spaced from the second section in the first lateral direction, and said bypass circuit being arranged and configured to bypass said third refrigerant tube on a discharge side of said compression mechanism, and at least one of said first refrigerant tube extending from said usage-side heat exchanger to said expansion mechanism, and said second refrigerant tube extending from said expansion mechanism to said heat source-side heat exchanger.

2. The air conditioning apparatus according to claim 1, wherein said bottom plate does not have an opening penetrating therethrough in a plate-thickness direction in a portion positioned on a side of said blower with respect to said heat source-side heat exchanger as seen in a planar view.

3. The air conditioning apparatus according to claim 1, wherein said bottom plate has drainage ports penetrating therethrough in a plate-thickness direction below said heat source-side heat exchanger.

4. The air conditioning apparatus according to claim 1, rein said heat source-side heat exchanger has a compression mechanism-side refrigerant passage port on a side of said compression mechanism, an expansion mechanism-side refrigerant passage port on a side of said expansion mechanism, and heat exchange flow passages extending so as to exchange heat between an outside liquid and refrigerant that passes therethrough from said compression mechanism-side refrigerant passage port to said expansion mechanism-side refrigerant passage port, and said heat exchange flow passages include a first branch point, a second branch point provided closer to said expansion mechanism-side refrigerant passage port than said first branch point, a first and second branch tubes arranged and configured to connect said first branch point and said second branch point by an independent path, and a juncture tube connecting said second branch point and said expansion mechanism-side refrigerant passage port and passing below at least one of said first branch tube and said second branch tube.

5. The air conditioning apparatus according to claim 4, wherein said heat source-side heat exchanger further has a fin penetrated therethrough by said juncture tube and at least one of said first branch tube and said second branch tube, and a penetrating portion of the at least one of said first branch tube and said second branch tube penetrating through said fin, and a penetrating portion of said juncture tube penetrating through said fin are connected.

6. The air conditioning apparatus according to claim 1, wherein at least a portion of said bottom plate adjacent to a portion through which said bypass circuit passes has bypass gutters formed so as to sink downward; and at least a portion of said bypass circuit is disposed on a top side of said bypass gutters in a space lower than a periphery of said bypass gutters.

7. The air conditioning apparatus according to claim 6, wherein said bypass gutters have inclined portions; and said bottom plate has gutter openings penetrating therethrough in a plate-thickness direction adjacent to a bottom end of the inclined portions of said bypass gutters.

8. The air conditioning apparatus according to claim 7, wherein said bypass circuit has a portion that is inclined so that a part of said bypass circuit passing above said gutter openings is a bottom end of said bypass circuit.

9. The air conditioning apparatus according to claim 7, wherein at least a part of a portion of said bypass circuit passing below said heat source-side heat exchanger is positioned above said gutter openings.

10. The air conditioning apparatus according to claim 1, further comprising:

a connection switching valve connected to an end part of said third refrigerant tube on a side opposite from said compression mechanism; wherein said connection switching valve is switchable between a first connection state in which refrigerant discharged from said compression mechanism is directed toward said usage-side heat exchanger, and a second connection state in which refrigerant discharged from said compression mechanism is directed toward said heat source-side heat exchanger.

11. The air conditioning apparatus according to claim 1, wherein said bypass circuit has a depressurizing mechanism arranged and configured to reduce pressure of refrigerant passing through the bypass circuit, and said bypass circuit bypasses the second refrigerant tube that extends from said expansion mechanism to said heat source-side heat exchanger, and the third refrigerant tube on the discharge side of said compression mechanism.

12. The air conditioning apparatus according to claim 1, wherein:

said bypass circuit extends along said upper surface of said bottom plate such that said bypass circuit is below said blower, said bypass circuit is arranged and configured to connect the third refrigerant tube and at least one of the first refrigerant tube and the second refrigerant tube, and the air conditioning apparatus further includes a bypass switching part switchable between a state of allowing flow of refrigerant from the third refrigerant tube to at least one of the first refrigerant tube and the second refrigerant tube in said bypass circuit and a state of not allowing the flow of refrigerant in said bypass circuit.

13. The air conditioning apparatus according to claim 12, further comprising:

a switch controller arranged and configured to switch said bypass switching part to the state of allowing flow of refrigerant in said bypass circuit in a case in which a defrost operation is performed to remove frost that adheres to said heat source-side heat exchanger.

14. The air conditioning apparatus according to claim 1, wherein the bypass circuit passes through both a position within a downward projection of the heat source-side heat exchanger and a position within a downward projection of the blower.

* * * * *